US007889041B2

(12) United States Patent
Minteer

(10) Patent No.: US 7,889,041 B2
(45) Date of Patent: Feb. 15, 2011

(54) SYSTEMS AND METHODS FOR FORMING AN ISOLATED TRANSFORMER

(75) Inventor: Timothy M. Minteer, Pullman, WA (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 691 days.

(21) Appl. No.: 11/935,166

(22) Filed: Nov. 5, 2007

(65) Prior Publication Data

US 2009/0115564 A1 May 7, 2009

(51) Int. Cl.
*H01F 5/00* (2006.01)

(52) U.S. Cl. ..... 336/200

(58) Field of Classification Search ..... 336/65, 336/83, 180–184, 200, 205–208, 220–223, 336/232

See application file for complete search history.

(56) References Cited

U.S. PATENT DOCUMENTS

| | | | |
|---|---|---|---|
| 3,940,678 | A | 2/1976 | Koyama |
| 4,025,849 | A | 5/1977 | Nihashi et al. |
| 4,066,974 | A | 1/1978 | Reinhard |
| 4,068,135 | A | 1/1978 | Sonobe et al. |

(Continued)

FOREIGN PATENT DOCUMENTS

JP 09236624 A 9/1997

(Continued)

OTHER PUBLICATIONS

PCT/US2008/082219 Patent Cooperation Treaty, From the International Bureau, PCT Notification Concerning Transmittal of International Preliminary Report on Patentability (Chapter 1 of Patent Cooperation Treaty), Date of Mailing: May 11, 2010, Applicant: Schweitzer Engineering Laboratories, Inc.

(Continued)

*Primary Examiner*—Tuyen Nguyen
(74) *Attorney, Agent, or Firm*—Eugene M. Cummings, P.C.

(57) ABSTRACT

A transformer to isolate a primary winding from a signal winding include a primary substrate (which may comprise a printed circuit board (PCB)) and a secondary substrate. The primary and secondary substrates may each have three openings to allow first and second E-E core halves to be joined therebetween. A first insulator may be disposed between the primary and secondary substrates to isolate the primary substrate from the secondary substrate. A second insulator may secure the primary and secondary substrates in place and insulate the secondary substrate from the core. The primary and secondary substrates may each include a Faraday shield its outer layers. A shield slit to prevent shorting between the legs of the E-E core may be formed by cutting a channel in the shield between the opening of the primary and secondary substrates. A retaining clip may be used to clamp together the primary substrate, first and second core E-E core halves, secondary substrate and second insulator. A primary winding and sense winding may be disposed within the primary substrate and a signal winding may be disposed within the secondary substrate. The primary, sense, and signal windings may be positioned so that the magnetic flux produced by the primary winding passes through the signal and sense windings in substantially equal proportions. The primary and signal winding may enter the E-E core from opposite directions to choke any common mode current therebetween.

18 Claims, 9 Drawing Sheets

U.S. PATENT DOCUMENTS

| | | | | |
|---|---|---|---|---|
| 4,152,660 | A | 5/1979 | Olschewski | |
| 4,286,225 | A | 8/1981 | Morong | |
| 4,317,963 | A | 3/1982 | Chea, Jr. | |
| 4,506,230 | A | 3/1985 | Ashley-Rollman | |
| 4,700,174 | A | 10/1987 | Sutherland et al. | |
| 4,740,744 | A | 4/1988 | Lubarsky | |
| 4,797,627 | A | 1/1989 | Chism et al. | |
| 4,949,030 | A | 8/1990 | Tse | |
| 4,970,459 | A | 11/1990 | Germer | |
| 5,767,744 | A | 6/1998 | Irwin | |
| 6,392,476 | B1 | 5/2002 | Rodriquez | |
| 6,587,026 | B2 * | 7/2003 | Yeh et al. | 336/223 |
| 6,737,916 | B2 | 5/2004 | Luu | |
| 6,828,894 | B1 * | 12/2004 | Sorger et al. | 336/200 |
| 6,980,074 | B1 * | 12/2005 | Jitaru | 336/200 |
| 7,106,048 | B1 | 9/2006 | Feight et al. | |
| 7,271,580 | B1 | 9/2007 | Fenske et al. | |
| 2010/0060261 | A1 | 3/2010 | Cadoux | |

FOREIGN PATENT DOCUMENTS

| | | |
|---|---|---|
| WO | WO2005/008692 | 1/2005 |

OTHER PUBLICATIONS

PCT/US2008/082213, Patent Corporation Treaty, International filing date November 3, 2008, from the International Searching Authority, Notification of Transmittal of the International Search Report and the Written Opinion of the International Searching Authority, or the Declaration for Applicant Schweitzer Engineering Laboratories, Inc.

PCT/US2008/082219, Patent Corporation Treaty, International filing date November 3, 2008, from the International Searching Authority, Notification of Transmittal of the International Search Report and the Written Opinion of the International Searching Authority, or the Declaration for Application Schweitzer Engineering Laboratories, Inc.

* cited by examiner

SYSTEMS AND METHODS FOR FORMING AN ISOLATED TRANSFORMER

TECHNICAL FIELD

This disclosure relates generally to isolating an analog signal and, more specifically, to an isolated transformer formed on a substrate to isolate an input analog signal from an output signal.

BRIEF DESCRIPTION OF THE DRAWINGS

Additional aspects and advantages will be apparent from the following detailed description of preferred embodiments, which proceeds with reference to the accompanying drawings, wherein.

Figure 1:
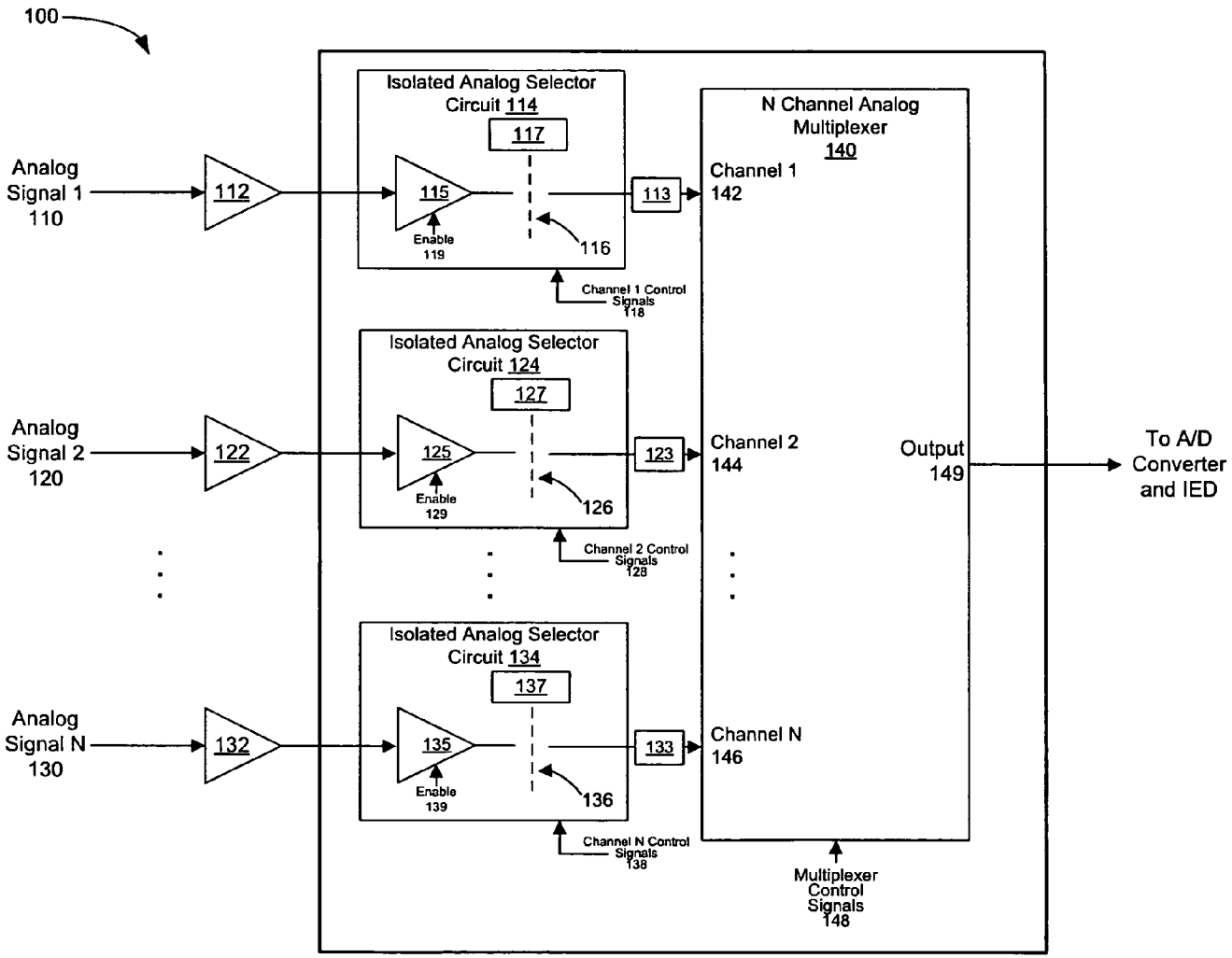
FIG. 1 is a block diagram of one embodiment of a plurality of isolated analog circuits coupled to an analog multiplexer and analog to digital converter.

Analog acquisition systems play a critical role in many different systems, including: power utility protection systems; Supervisory Control and Data Acquisition (SCADA) systems; and a large number of other control and data acquisition systems in various fields (e.g., automotive, industrial, medical, and the like). For example, a power utility and/or transmission system may comprise various devices that use analog acquisition systems, including: monitoring devices; system control devices; metering devices; and protective devices (e.g., protective relays). In most cases, these devices are microprocessor-based or "intelligent electronic devices" (IEDs), such as protective relays, communications processors, phasor measurement units, digital fault recorders, and the like.

IEDs may require accurate analog measurements in order to properly monitor, control, meter, and/or protect a power system. Recent advancements in phase-magnitude measurement technology with respect to time stamping and/or time alignment of such measurements have made new monitoring, control, protection, and/or metering functions feasible. One such technology comprises generating so-called synchrophasor measurements according to the teachings of United States Patent Application Pub. No. 2007/0086134, entitled "Apparatus and Method for Estimating Synchronized Phasors at Predetermined Times Referenced to an Absolute Time Standard in an Electrical System" to Zweigle et al., which is herein incorporated by reference in its entirety.

Generally, analog acquisition systems require some form of isolation between the analog signal to be measured and the digital control system and/or IED performing the measurement. The isolation may be needed for safety reasons as well as protection of the digital control system and/or IED from damage due to transient conditions in the power system (e.g., voltage/current spikes, faults, or the like). For example, an IED in a power system, such as a digital protective relay, may require 3 kV of isolation at 60 Hz between the current transformer (CT) and voltage transformer (VT) signals and the digital control circuitry acquiring the measurement.

Isolation between the input analog signal and IED may prevent direct electrical communication between the input analog signal and the IED. Accordingly, as used herein, this isolation may refer to "electrical isolation" or simply "isolation." Although electrically isolated, an analog signal may be in electromagnetic communication with an IED performing a measurement of the input analog signal. For example, an IED may measure a magnetic field produced by the analog signal and/or may generate a current and/or voltage from the magnetic field. In this case, the IED may not be in electrical communication with the input analog signal, but may measure the signal via electromagnetic communication.

Such isolation may be achieved by using an isolation transformer. An isolation transformer may comprise a primary winding and a secondary winding (signal winding) insulated from one another to meet the isolation requirements of the system. The input analog signal may drive the primary winding, and the measuring device (e.g., IED) may acquire the signal at the signal winding. The transformer may be designed to support the current or voltage range of the input analog signal as well as the frequency of the analog signal. The primary winding may be electrically coupled to the analog signal, and the signal winding may be electrically coupled to the acquisition system. The output of the signal winding may be a linear representation of the primary analog signal. As such, ideally, the output should have the same frequency, a proportional magnitude, and a consistent phase delay with respect to the primary signal.

One such transformer is a so-called "iron-core" transformer, which may comprise an iron-based core to isolate a 60 Hz CT or VT signal. The transformer core may be physically large enough to support the largest waveform that is to be measured. However, this type of isolation transformer has several drawbacks: first, for large fault currents, which may have a fully decaying direct current offset, the isolation transformer may saturate; second the transformer may become non-linear for low CT signals; and third, the phase through the isolation iron-based core transformer may not be consistent from part to part or over the entire range of the CT signal.

The construction of transformers having an iron-based core may be a manual labor intensive process. For instance, during construction, the pieces of the core laminates must be forced into bobbins, and insulation tape must be added between the primary and secondary magnetic wire layers. The magnetic wires must then be soldered to lead wires or binding post to provide the interface for crimp terminals or wave soldering on a printed circuit board (PCB). The resulting transformer system may be impregnated or dipped in varnish to protect the magnetic wires and other components from the environment. All of these manual steps in the construction process of an iron-based core transformer may adversely impact its quality and reliability and increase its cost.

Another issue with iron-based core isolation transformers is the weight they may add to a device. For instance, a digital protective relay and/or IED, may comprise numerous isolation transformers which may weigh approximately ⅔ pounds each. This may represent a significant portion of the total weight of the IED and may complicate installation and/or maintenance of the IED.

In some cases, the analog signal to be isolated may be at a very low frequency (e.g., a power, frequency, and/or temperature transducer signal). Conventional isolation transformers, such as an iron-core isolation transformer, may not be capable of isolating the signal. Instead, for these types of signals, non-galvanic isolation may be achieved with a operational and/or differential amplifier circuit, or galvanic isolation may be achieved with an isolation amplifier. Both methods have drawbacks. A differential amplifier may not provide a galvanic isolation and may have poor common mode rejection since common mode rejection is mainly a function of how closely matched the circuit resistances are. Isolation amplifiers are typically costly and may require a power supply on both sides of the isolation module.

Many acquisition systems require a high degree of accuracy for the sampled isolated analog signals. For example, some IEDs, such as a digital protective relay, may incorporate a 16-bit, analog-to-digital (A/D) converter. Such an IED may require the measured precision of the voltage and/or current signals to be within a few counts of the A/D converter (i.e., within 1 to 2 bits of precision of the A/D converter). It may also be important that this accuracy is maintained over operating temperature extremes of the acquisition system.

Conventional differential amplifiers and isolation amplifiers may not be capable of achieving the required level of accuracy. Further, if a traditional isolation amplifier system were to be constructed to the tolerances required to achieve higher precision, it would result in significantly increased cost, potentially many times that of a conventionally construed iron core CT or VT system.

Typical acquisition systems incorporate a single A/D converter and/or other capture circuitry to sequentially sample every analog signal in the system in a round-robin type fashion. For example, an IED monitoring a three-phase power system captures four current (CT) signals ($I_A$, $I_B$, $I_C$, and $I_N$) and three voltage (VT) signals ($V_A$, $V_B$, and $V_C$). In this case, the IED may sequentially sample $I_A$, $I_B$, $I_C$, $I_N$, $V_A$, $V_B$, and $V_C$ and then repeat the process.

As used herein, "capture circuitry" may refer to any circuitry and/or system capable of capturing an analog signal including, but not limited to: an analog-to-digital converter; sample-and-hold circuitry; a switching capacitor; an analog memory; or the like. Although the disclosure discusses the use of particular capture circuitry implementations (e.g., and A/D converter), one skilled in the art would recognize that the teachings of this disclosure may be used with any capture circuitry. As such, this disclosure should not be read as limited to any particular capture circuitry implementation.

In a sequential sampling system, 192 samples per 60 Hz cycle for each of 16 analog signals (channels) may be obtained using a single A/D converter. Typically, an A/D conversion may be performed in 5 microseconds. As such, each signal may need to be valid for 5 microseconds during each 87 microsecond period $$\left(\frac{1}{60*192} \cong 87\ \mu\ \text{sec}\right)$$

for conversion by the A/D converter. Accordingly, an analog isolation circuit of this disclosure may only drive the analog signal across the isolation barrier for the time required for the sample capture to take place (e.g., 5 microseconds per 87 microsecond period). This may allow the transformer of this disclosure to be smaller and more efficient that a transformer that constantly maintains the analog signal across the isolation barrier.

The analog signal isolator of this disclosure may only bring the analog signal across the isolation barrier for the portion of time that it is needed by the A/D converter. As such, the isolation transformer of this disclosure may be significantly reduced in size and weight. For instance, in a digital protective relay IED, only a small fraction (e.g., $1/1000^{th}$) of the magnetics may be required.

Another issue prevalent in typical isolation transformers is poor accuracy. As discussed above, an isolation transformer may operate using an input analog signal to drive a primary transformer winding in electromagnetic communication with a signal winding to create a linear approximation of the analog input. However, error may be created since the input signal may change as the input analog signal magnetizes the primary winding of the transformer (e.g., a voltage drop may occur as the magnetizing current ramps up). Additional error may be created by series resistance as the analog input signal is switched on and off and/or connected. In addition, the amount of magnetizing and other resistance may vary depending upon the electrical components used in the isolation transformer and the ambient temperature (e.g., the electrical components may change their resistance and/or reactance with temperature).

Due in part to these errors, a conventional transformer would likely perform poorly in a system according to the teachings of the disclosure where the analog input signal is switched on and off depending upon which analog signal is being measured at a particular sample time (e.g., switched on for 5 microseconds during each 87 microsecond measurement period).

Some isolation transformers have attempted to address accuracy issues in the output signal. For example, some systems have attempted to compensate for the magnetizing voltage drop by sampling the output analog signal twice and estimating the actual measurement value from the two samples. However, the precision of the estimation algorithm may be lacking due to variance of when the actual times the signal is sampled. Additionally, the accuracy of the system may vary significantly due to, among other things: temperature swings; changes in transformer permeability; and transients when a particular analog input signal is switched to the transformer (the switching is not a simple step function and, as such, cannot be accurately estimated using two measurements).

In another approach, a third transformer winding (referred to herein as a "sense winding") may be used to estimate the voltage drop error created by magnetizing current generated during primary winding ramp up. A compensation operational amplifier (op amp) may be used to amplify a difference between an input analog signal and the output of the sense winding. However, this approach may introduce unacceptable errors for a precision acquisition system. First, the op amp's output impedance in combination with the series resistor of the output filter and analog switch may cause the closed loop gain of the compensation op amp to be significantly reduced when driving the magnetizing inductance load of the primary winding. This reduction may result in error on the output signal. Second, stabilizing feedback used with the compensation op amp (e.g., a capacitor from the output of the op amp to the negative input of the op amp) may produce an effectively direct current as the op amp ramps up. This current may flow through an input resister connected to the negative input of the amplifier, creating additional error. Third, the closed loop settling response of the op amp when the output is connected to the isolation transformer and/or any switching transients that occur when any of the analog switches are modified may impact both the average signal level present on the output capacitors (error with respect to the input signal) as well as transient perturbations around the average signal level. Fourth, error due to mismatch of magnetic coupling between the isolation transformer's primary-sense and primary-signal windings may exist. Each of these errors may vary with different transformer configurations and circuit components and will significantly vary over temperature swings.

In addition, these systems may require a separate transformer to supply power to the op amp across the isolation barrier and to communicate control signals to its analog switches. Further, given the non-settling transients created by the op amp, there may be no ideal output signal sampling time.

In yet another approach, additional transformer windings may be provided to act as a power supply for the compensation op amp across the transformer isolation barrier. The system may still suffer, however, from unacceptable precision errors due to other circuit components, such as a flyback modulator/demodulator used to provide power. In particular, the system's closed loop response may suffer from gain loss as the magnetizing current ramps up in the primary winding, and un-settling transients may be created due to its switching action. In addition, error may be created between flyback demodulators in both the feedback loop of the op amp and in the output signal. Like the other systems discussed above, these errors may vary with different transformer and circuit components, and may significantly vary over temperature swings.

The isolation transformer of this disclosure may address the weight penalty and precision lacking in conventional isolation transformer systems. First, since the isolated analog selector of this disclosure only brings the analog signal across the isolation barrier for the period of time it is needed by the A/D converter, the transformer may be reduced in size and weight. The precision errors of conventional systems may be addressed in a number of ways. First, a compensation op amp may be used to drive, through a drive amplifier, the isolation transformer's primary winding with negative feedback from a tertiary (sense) winding to compensate for any voltage drop that would normally occur as magnetizing current flows through the series resistance of the output stage (of the op amp) and primary winding. Second, a drive amplifier may directly drive the primary winding and be controlled by the compensation op amp. The drive amplifier may be designed to have minimal output impedance such that the net resistance between the drive amplifier and the isolation transformer inductance is reduced to substantially the primary winding resistance. The compensation op amp feedback loop may be stabilized by a lead-lag compensation network. The output signal may be stabilized with a snubber.

A. Isolated Analog Selector

Turning now to FIG. 1, a block diagram of one embodiment of an isolated analog signal capture system 100 is depicted. As discussed above, an analog signal capture system 100 of this disclosure may monitor a plurality of analog signals corresponding to voltage and/or current phase components of a three-phase electrical power system. Accordingly, embodiment 100 depicts an analog signal multiplexer capable of multiplexing N analog signals where N may represent the number of analog signals to be acquired (e.g., 16 analog signals).

Embodiment 100 may receive N analog signal inputs including, 110, 120, and 130. Analog signal input 110 may pass through low pass filter (LPF) 112. LPF 112 may prevent aliasing from occurring due to the A/D sampling process. LPF 112 may be used because analog signal one (1) 110 may comprise high-frequency components that are not to be measured (e.g., signal one (1) 110 may include glitching and/or noise). As such, if analog signal one (1) 110 where to be sampled at a frequency that is too low to reconstruct these high frequency components, the low-frequency aliases of the undersampled high frequencies may appear in the signal, causing error. Therefore, LPF 112 may remove high frequency components before the sampling is done. Similar LPF filters 122 and 132 may be used in conjunction with the other analog signal inputs 120 through 130.

The output of LPF 112 may flow to isolated analog selector circuit 114 which may generate a precise linear representation of the filtered analog input signal 110 across isolation barrier 116 to sample-and-hold 113 and the N channel analog multiplexer 140 for the portion of time when the A/D converter (not shown) is performing a capture of the signal on channel one (1) 142. Similarly, the output of LPF 122 may flow to isolated analog selector circuit 124, and the output of LPF 132 may flow to isolated analog selector circuit 134.

Analog selector circuit 114 may comprise analog buffer 115 which may be enabled for the time required for the A/D conversion of analog signal one (1) 110 as well as some time prior to the capture to allow the isolation circuitry to settle. As such, analog buffer 115 may receive an input enable signal 119 derived from channel one (1) control signals 118. Channel one (1) control signals 118 may be derived from and/or related to multiplexer control signals 148 such that analog buffer 115 is enabled while channel one (1) 142 input of analog multiplexer 140 is selected. Similarly, analog selector circuits 124 and 134 may comprise analog buffers 125 and 135 driven by an enable signal 129, 139. Enable signals 129 and 139 may be derived from their respective channel control signals 128 and 138 and may cause analog buffers 125 and 135 to be enabled during and/or prior to the selection of channel 2144 and channel N 146, respectively.

Each analog selector circuit 114, 124, 134 may comprise an isolation barrier 116, 126, 136 to individually isolate each filtered analog signal 110, 120, 130 from sample-and-hold circuitry 113, 123, 133, the multiplexer 140, sample-and-hold system (not shown) and/or A/D converter (not shown), and the IED (not shown). As discussed above, this may prevent transients, faults, and/or glitches on analog inputs 110, 120, or 130 from damaging the multiplexer 140, A/D converter and/or IED.

Sample-and-hold circuits 113, 123, and 133 may sample and hold the output of isolated analog selector circuits 114, 124, 134 while multiplexer 140 selects one of its N inputs 142, 144, and 146. In some embodiments, multiplexer 140 may comprise an A/D converter and changes on other inputs, 142, 144, and 146 may create error in the conversion of the input selected by control signal 148. As such, sample-and-hold circuits 113, 123, 133 may be used hold the inputs 142, 144, 146 of multiplexer 140 constant while the A/D conversion (or other capturing method) takes place. Of course, in other embodiment, where the multiplexer 140 does comprise an A/D converter and/or is unaffected by changes to inputs 142, 144, or 146 during conversion, sample-and-hold circuits 113, 123, 133 may not be needed.

Multiplexer 140 may receive multiplexer control signals 148 which may direct multiplexer 140 to select one of input channels 142, 144, through 146 on output 149. Multiplexer control signals 148 may determine and/or correspond to channel control signals 118, 128, 138 and/or analog buffer enable signals 119, 129, 139 such that when a particular input 142, 144, or 146 is active, the corresponding control signal 118, 128, 138 and/or enable signal 119, 129, 139 is similarly active.

Output 149 of multiplexer 140 may flow to an A/D converter which may produce a digital equivalent of the analog signal 110, 120, or 130. As discussed above, the A/D converter may be communicatively coupled to an IED which may use the digital equivalent of the analog signal as part of a monitoring, metering, and/or protective function. In addition, the IED may transmit the measurement, and corresponding time stamp, to a remote IED.

In an alternative embodiment, output 149 of multiplexer 140 may flow to another capture and/or sampling system, including, but not limited to: a sample-and-hold circuit; a switching capacitor; or the like. As such, this disclosure should not be read as limited to any particular capture and/or sampling mechanism.

As can be seen in FIG. 1, only one of the analog signals 110, 120, 130 need pass through the isolation barrier 116, 126, 136 at any particular sampling time. As such, embodiment 100 may be optimized such that the buffers on the "left hand" side of the isolation barrier (e.g., buffers 115, 125 and 135), may only be powered and/or enabled during the sampling time for the particular analog signal 110, 120, 130. As discussed above, since the output of each isolation transformer circuit 114, 124, 134 need only be valid when the output is captured by the A/D converter, the isolation transformer circuits 114, 124, 134 may consume less power and comprise fewer magnetics than similar isolation transformers that must constantly maintain a valid output signal.

Isolated analog selector circuits 114, 124, and 134 may further comprise a power supply 117, 127, and 137. Power supply 117 may comprise a forward converter/push-pull switching power supply and may produce the voltage rails necessary for LPF 112 and analog buffer 115 and other circuitry of isolated analog selector 114. Power supply 117, 127, 137 may comprise energy storage means including, but not limited to, one or more capacitors, a battery, or the like.

Figure 2:
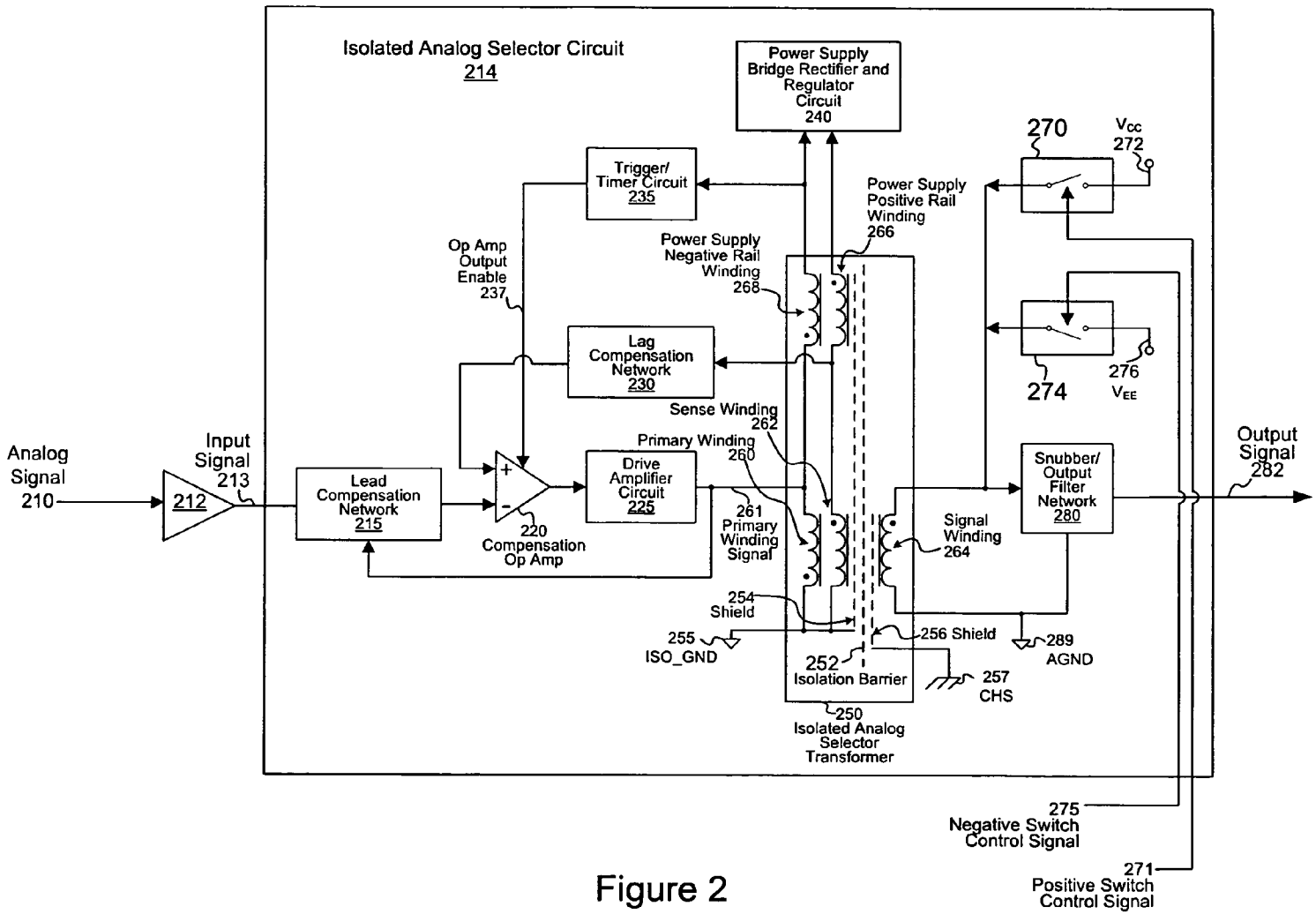
FIG. 2 is a block diagram of one embodiment of an isolated analog circuit.

Turning now to FIG. 2, a block diagram of one embodiment of an isolated analog selector circuit 214 is depicted. The isolated analog selector circuit 214 depicted in FIG. 2 may correspond one or more of the isolated analog circuits 114, 124, 134 of FIG. 1.

As discussed above, isolated analog selector circuit 214 may receive an analog input 213 which may be derived from an analog signal 210 processed by a LPF 212. Although the electrical communication is not shown, LPF 212 may be powered by power supply bridge rectifier and regulator circuit 240. LPF 212 may comprise any LPF implementation known in the art.

The analog input 213 may flow through lead compensation network 215 to a negative input of compensation operational amplifier (op amp) 220. The positive input of the op amp 220 may be formed by an output of a sense winding 262. Lag compensation network 230 may be used to process an output of sense winding 262. The signal produced on sense winding 262 may comprise negative feedback to compensation operational amplifier 220. The design and operation of lead compensation network 215 and lag compensation network 230 is discussed in more detail below in conjunction with FIG. 4.

Compensation op amp 220 may generate primary winding signal 261 to drive primary winding 260 of the isolation analog selector transformer 250. In the FIG. 2 embodiment, signal 261 may be driven by drive amplifier circuit 225. In an alternate embodiment (i.e., where compensation op amp has low output impedance), compensation op amp 220 may directly drive primary winding 260 with primary winding signal 261. Both primary winding 260 and sense winding 262 may terminate at isolated ground (ISO_GND) 255. Compensation op amp 220 may be controlled by enable signal 237. When enabled by 237, compensation op amp 220 may drive primary winding 260 with the difference between the filtered input analog signal 213 as processed by lead compensation network 215 and the output of the sense winding 262 and input analog signal as processed by lag compensation network 230.

Drive amplifier circuit 225 may have minimal output impedance such that the net resistance between the drive amplifier 225 and the isolation transformer magnetizing inductance is basically the primary winding resistance. Accordingly, the closed loop gain of the compensation op amp 220 and adjoining circuitry may be maintained at a sufficiently high gain such that any error is within acceptable margins (e.g., within two counts of a 16-bit A/D converter). As discussed above, this may prevent error due to reduced gain caused by such resistance. In other embodiments, drive amplifier 225 may be incorporated in the integrated circuits of compensation op amp 220.

Compensation op amp 220 may use negative feedback from sense winding 262 of isolated analog selector transformer 250 to compensate for the voltage drop that would otherwise occur when isolation transformer magnetizing inductance current flows (ramps up) through the series resistance of the output stage and primary winding 260. This may cause the output of the signal winding 264 to be an accurate scaled linear representation of input signal 213. Accordingly, the use of compensation op amp 220 may increase the accuracy of the isolated analog selector circuit 214.

Primary winding signal 261 may drive primary winding 260. In one embodiment, signal 261 may be produced directly by compensation op amp 220. In the FIG. 2 embodiment, primary winding signal 261 may be generated by drive amplifier circuit 225. Drive amplifier 225 may be controlled by compensation op amp 220 (i.e., the output of compensation op amp 220 feeds into drive amplifier circuit 225). As discussed above, drive amplifier 225 may be configured such that the closed loop gain of the compensation op amp 220 is maintained at a high enough level that the corresponding error is in an acceptable range (e.g., one ore two counts of a 16-bit A/D converter).

Compensation op amp 220 may be stabilized by lag compensation network 230 and lead compensation network 215. Lag compensation network 230 may be disposed between sense winding 262 and the positive input of compensation op amp 220. The output of lag compensation network 230 may represent negative feedback to compensation op amp 220 since the sense winding 262 may be inverted relative to the primary winding 260. Lead compensation network 215 may be disposed between the output of the drive amplifier circuit 225 and the negative input of compensation op amp 220 such that when the output of the drive amplifier circuit 225 is ramping up, any corresponding capacitance current may not introduce error. Lead compensation network 215 and lag compensation network 230 may form a lead-lag compensator network as is well known in the control system arts. As such, lead and lag compensation networks 215, 230 may introduce a pole-zero pair into the open loop transfer function of compensation op amp 220 and drive amplifier circuit 225 to increase the responsiveness and stability of the system. Implementation details for lead compensation network 215 and lag compensation network 230 are provided below in conjunction with FIG. 4.

Signal winding 264 may be in electromagnetic communication with primary winding 260 across isolation barrier 252 and Faraday shields 254 and 256. Faraday shield 256 may be electrically connected to a chassis 257. Signal winding 264 may terminate to analog ground (AGND) 289. As discussed above, isolation barrier 252 may be configured to isolate the analog input signal 213 from output signal 282. In embodiment 214, this may be done using isolated analog selector transformer 250. As discussed above, isolated analog selector transformer 250 may comprise primary winding 260 driven by compensation op amp 220 and drive amplifier circuit 225 which may be driven by the filtered analog input signal 213. Primary winding 260 may drive signal winding 264 to produce a scaled linear equivalent of filtered analog input signal 213 on signal winding 264. The negative feedback loop created using sense winding 262 and compensation op amp 220 may reduce error by compensating for the voltage drop that would otherwise occur as the magnetizing inductance current flows through the series resistance of the output stage and primary winding 260. As such, signal winding 264 may produce an accurate scaled linear equivalent of filtered analog input signal 213.

The output of signal winding 264 may flow to snubber/output filter network 280. Snubber/output filter network 280 may stabilize the compensation op amp circuitry by de-Qing the magnetization inductance and parasitic inductances and capacitances. Implementation details for one embodiment of snubber/output filter network 280 are provided below in conjunction with FIG. 4.

The output of snubber/output filter network 280 may form output signal 282 which may flow to an input of a multiplexer (not shown), A/D converter (not shown), and/or sample-and-hold circuitry (not shown). As discussed above, due to the negative feedback received from sense winding 262, compensation op amp 220 may drive primary winding 260 such that signal winding 264 may be a linear representation of input analog signal 213.

Signal winding 264 be driven by positive switch control signal 271 through forward converter power supply positive rail switch circuit 270 and/or may be driven by negative switch control signal 275 through forward converter power supply negative rail switch circuit 274. As will be discussed below in conjunction with FIGS. 3*a* and 3*b*, positive switch control signal 271 and negative control signal 275 may be used to control power to isolated analog selector circuit 214 across isolation barrier 252 using power supply bridge rectifier and regulator circuit 240. In this embodiment, control signals 271 and 275 may comprise alternating square wave signals to selectively connect signal winding 264 to a positive supply voltage and a negative supply voltage, creating alternating positive and negative pulses on positive and negative rail windings 266, 268.

In this embodiment, when the positive switch control signal 271 is high and/or asserted, forward converter power supply positive rail switch 270 may turn on (i.e., close), and positive voltage supply rail ($V_{CC}$) 272 may be applied to signal winding 264, producing a positive voltage on the power supply positive rail winding 266 and negative voltage on the power supply negative rail winding 268. Otherwise, when negative switch control signal 275 is high and/or asserted, forward converter power supply negative rail switch 274 may turn on (i.e., close), and negative voltage supply rail ($V_{EE}$) 276 may be applied to signal winding 264, producing a negative voltage on the power supply positive rail winding 266 and positive voltage on the power supply negative rail winding 268.

The alternating positive and negative voltage signals produced by $V_{CC}$ 272 $V_{EE}$ 276 and positive and negative switch control signals 271 and 275 may provide power to power supply bridge rectifier and regulator circuit 240 via signal winding 264 and positive and negative rail windings 266, 268. As discussed above, power supply bridge rectifier and regulator circuit 240 power the circuitry of isolated analog selector circuit 214 across isolation barrier 252.

One skilled in the art would recognize that a single positive and/or negative rail winding could be used in conjunction with power supply bridge rectifier and regulator circuit 240 (e.g., a single power supply winding). As such, this disclosure should not be read as limited to any particular power supply generating means and/or power supply windings.

Positive and/or negative rail winding 268 may flow to trigger timer circuit 235 (FIG. 2 depicts only negative rail winding 268 flowing to trigger timer circuit 235). As will be discussed below in conjunction with FIG. 3, a rapid oscillation in positive and/or negative switch control signal 271 and/or 275 may cause trigger/timer circuit 235 to activate op amp output enable signal 237. The generation of the op amp output enable signal 237 will be discussed in greater detail in conjunction with FIGS. 3*a* and 3*b* below.

Figure 3A:
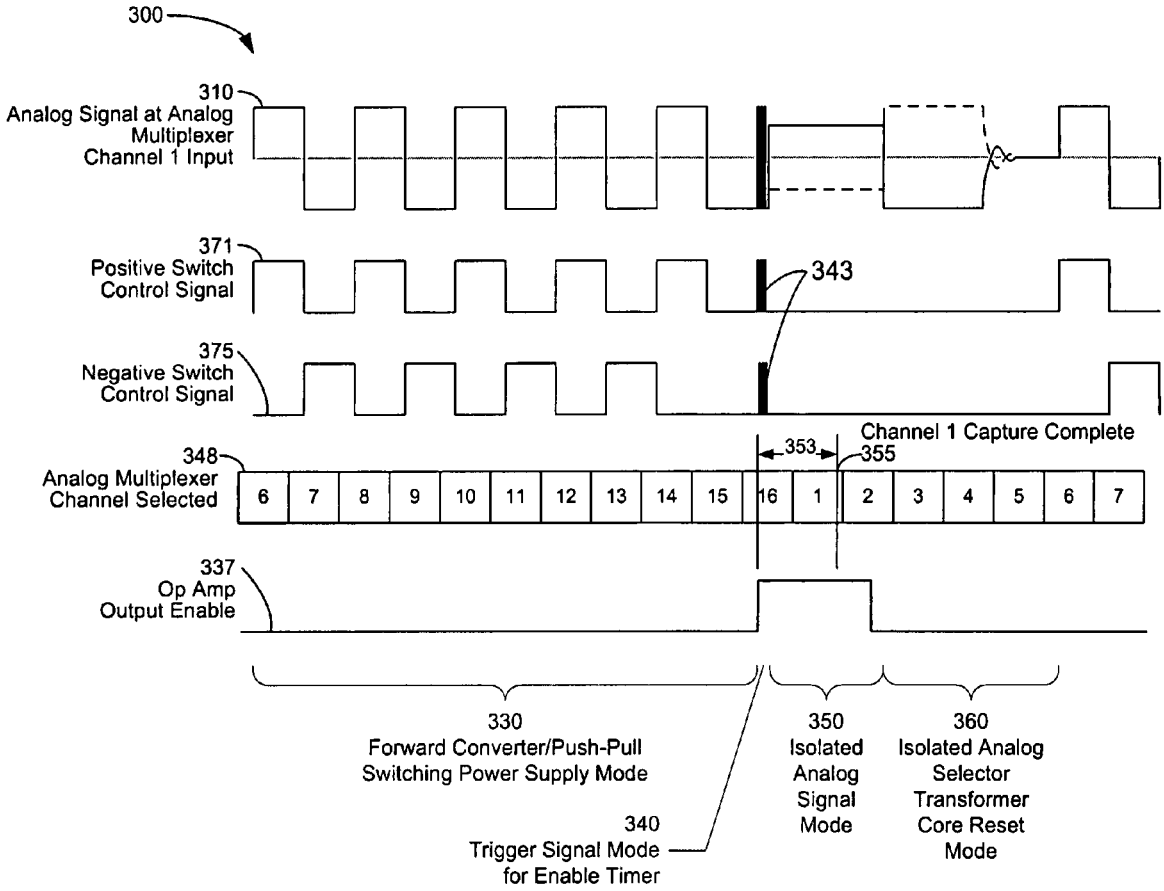
FIGS. 3*a* and 3*b* are block diagrams of control signals of an embodiment of an isolated analog circuit.
Figure 3B:
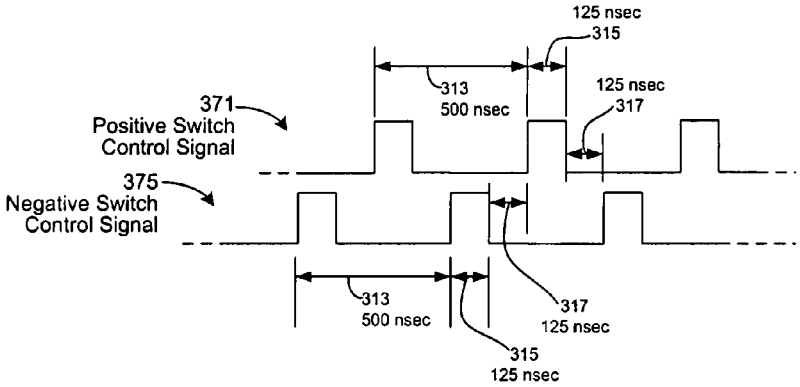

Turning now to FIGS. 3*a* and 3*b*, a timing diagram 300 of one embodiment of isolated analog selector circuit control signals is depicted. The control signals of FIGS. 3*a* and 3*b* may comprise control signals corresponding to channel one (1) 118 of isolated analog selector circuit 114 of FIG. 1. One skilled in the art, however, would understand that control signals 300 could be modified (e.g., shifted) to correspond to control signals for any channel two (2) through N of FIG. 1.

The control signals depicted in timing diagram 300 may relate to and/or be aligned with analog multiplexer channel control signal 148 of FIG. 1 (signal 348 in FIG. 3*a*). As such, the channel selected on analog multiplexer channel selected 348 may represent the selected input channel on multiplexer 140 of FIG. 1 (i.e., analog multiplexer channel selected 348 may represent multiplexer control signals 148 of FIG. 1).

The isolated analog selector circuit may have four modes of operation, forward converter/push-pull switching power supply mode 330, trigger signal mode for enable timer 340, isolated analog signal mode 350, and isolated analog selector transformer core reset mode 360. An embodiment of each of these modes, as well as the transition between modes, is depicted in timing diagram 300. As discussed above, although FIG. 3 depicts an exemplary timing diagram for an analog signal connected to channel one (1) the multiplexer of FIG. 1, timing diagram 300 could be adapted for use with any of the other channels two (2) through N by shifting the control signals 310, 371, 375, and 337 relative to the channel one (1) control signals.

The first operational mode of embodiment 300 may be the forward converter/push-pull switching power supply mode 330 which may occur while the multiplexer is selecting analog channel inputs 6-15 (e.g., as analog multiplexer channel selected signal 348 cycles from 6 to 15). During this mode 330, positive switch control signal 371 and negative switch control signal 375 may be alternately switched (i.e., when positive switch control signal 371 is high, negative switch control signal 375 is low and vice versa). These alternating pulses 371, 375 may flow to an isolated analog selector circuit similar to that depicted in FIG. 2. As discussed in conjunction with FIG. 2, positive and negative switch control signals 371, 375 may cause a signal winding of the isolated transformer to be alternately connected to a positive source rail voltage ($V_{CC}$) and a negative rail source voltage ($V_{EE}$), providing power to a switching power supply, such as power supply bridge rectifier and regulator circuit 240 of FIG. 2. Accordingly, during operational mode 330, energy may be fed into the isolated analog selector circuit connected to the control signals of timing diagram 300.

As shown in FIG. 3*a*, during the other operational modes of embodiment 300 (modes 340, 350, 360), positive switch control signal 371 and negative switch control signal 375 may not be active and/or may not operate to excite the switches of a connected isolated analog selector circuit. As such, the power supply component of the isolated analog selector circuit (e.g., elements 117, 127, 137 of FIG. 1 and/or element 240 of FIG. 2) may comprise energy storage, including, but not limited to: one or more capacitors; one or more batteries; or the like. This may allow the power supply to provide power to the isolated selector circuit components across the isolation barrier during its other operational modes (i.e., modes 340, 350, and 360).

In the FIG. 3*a* embodiment, trigger signal node 340 may occur at the beginning of the selection period of channel sixteen (16) on analog multiplexer channel selected signal 348. During this mode 340, positive switch control signal 371 and negative switch control signal 375 may rapidly oscillate at 343 as depicted in FIG. 3*b*. FIG. 3*b* shows positive and negative switch control signals 371 and 375 switched on for 125 nanoseconds (element 315 in FIG. 3*b*) over a period of 500 nanoseconds (element 313 in FIG. 3*b*) three consecutive times. The rise time of positive switch control signal 371 may be offset from the fall time of negative switch control signal 375 by 125 nanoseconds (element 317 in FIG. 3*b*) and vice versa.

The trigger/timer circuit of the isolated analog selector circuit (e.g., element 235 of FIG. 2), may detect this oscillation (343) on the power supply negative and/or positive rail winding, causing trigger/timer circuit to activate op amp output enable signal 337 and activate a timer. The timer may be activated for approximately 12 microseconds. During the timer period (e.g., 12 microseconds after detecting the pulses of 343), the trigger/timer circuit may assert the compensation op amp enable signal (element 237 of FIG. 2). When the op amp output enable signal is asserted, the isolated analog selector circuit may be in the third mode of operation, isolated analog signal mode 350.

Referring again to FIG. 2, It should be noted that the op amp enable signal 237 could be generated in many other ways aside from a rapid rise and fall on the negative and/or positive windings of the isolated analog selector transformer 250 including, but not limited to: an optical isolator (isolation barrier 252 bridged by light) originating from one of the channel control signals; capacitive or inductive coupled signals across a gap (isolation barrier 252 bridged by electric and/or magnetic fields); or the like. In addition, there are many other ways that the op amp output enable signal 237 could be triggered including, but not limited to, counting the cycles of the forward converter/push-pull switch power supply mode and triggering the output 237 after a pre-determined number of cycles, waiting a certain amount of time using a timer circuit, generating another type of pattern using the positive and/or negative switch control signals 271 and 275, or the like. As such, this disclosure should not be read as limited to any particular enable control signal isolation barrier 252 crossing method and/or technique or enable signal generation method and/or technique.

During isolated analog signal mode 350, the compensation op amp of FIG. 2 (element 220), may be activated by op amp output enable 337. Referring again to FIG. 2, the op amp output enable signal 237 may be produced by trigger/timer circuit 235 depicted in FIG. 2. While compensation op amp 220 is active, it may adjust its output until the signal at the sense winding 262 matches the input signal 213 from the LPF 212. Once the circuitry comprising compensation op amp 220, drive amplifier circuit 225, primary, sense, and signal windings 260, 262, 264, and lead and lag compensation networks 215, 230 settles, the output signal presented on the signal winding 264 and output 282 may be an accurate scaled linear representation of the input analog signal 213.

FIGS. 3*a* and 3*b* depict isolated analog signal mode 350 as occurring before the A/D capture complete time 355. The time differential 353 between the assertion of op amp output enable 337 and channel one (1) A/D capture may allow the circuitry of the isolated analog selector circuit to settle as described above. The delay 353 may allow the A/D converter to complete capture at 355 to occur with minimal and/or acceptable error (e.g., one or two counts of a 16-bit A/D converter).

After A/D conversion, control signals 300 may enter isolated analog selector transformer core reset mode 360. In the FIG. 3 embodiment showing control signals for channel one (1), this mode 360 may begin during the channel two (2) selection time and end with the selection time of channel five (5) on analog multiplexer channel selector signal 348. During mode 360, there may be no circuitry actively driving the transformer of the isolated analog selector circuit (e.g., the compensation co amp 220 enable signal 237, 337 may be de-asserted). Referring back to FIG. 2, any energy trapped and/or stored in the isolated analog selector transformer's 250 core may dump into the power supply bridge rectifier and regulator circuit 240. It is well known in the electrical arts that energy in a transformer 250 should not be allowed to build up without limit since such a build up may cause a core of transformer 250 to saturate and could damage the switches of 270, 274, components of power supply bridge rectifier and regulator 240, and/or drive amplifier circuit 225.

Referring again to FIGS. 3*a* and 3*b*, after the completion of mode 360 (i.e., after the capture of channel five (5) on analog multiplexer channel selection 348 has been completed), the system may return to operational mode 330 to repeat the above described control system cycle.

The timing and control signals 300 depicted in FIGS. 3*a* and 3*b* may correspond to channel one (1) of FIG. 2. However, one skilled in the art would recognize that the rest of the input signals two (2) through sixteen (16) could be derived from FIGS. 3*a* and 3*b* by shifting the timing and control signals 300 along analog multiplexer channel selected 348. For example, timing and control signals for channel two (2) could be derived by shifting timing and control signals to the right on FIG. 3*a* by one (1) selection period of analog multiplexer channel selected 348. Timing and control signals for other channels three through sixteen (16) could be derived by performing similar shifts. Although FIGS. 3*a* and 3*b* depict control signals corresponding to sixteen (16) analog signals, it would be understood by one stilled in the art that control signals for a system comprising any number of analog signals derived according to the teachings of this disclosure.

The timing signals depicted in FIGS. 3*a* and 3*b* could be generated by any control signal generating technique and/or methodology known in the art including, but not limited to: a state machine; a field programmable gate array (FPGA); an application specific integrated circuit (ASIC); a general and/or specific purpose computing device; or the like. As such, the control signals of this disclosure should not be read as limited to any particular control signal generating means, technique, and/or methodology.

In addition, in an alternative embodiment, sample-and-hold circuitry could be used before or after the analog multiplexer of FIG. 1 with the sampling completion occurring at time 355 of FIG. 3*a*.

Figure 4:
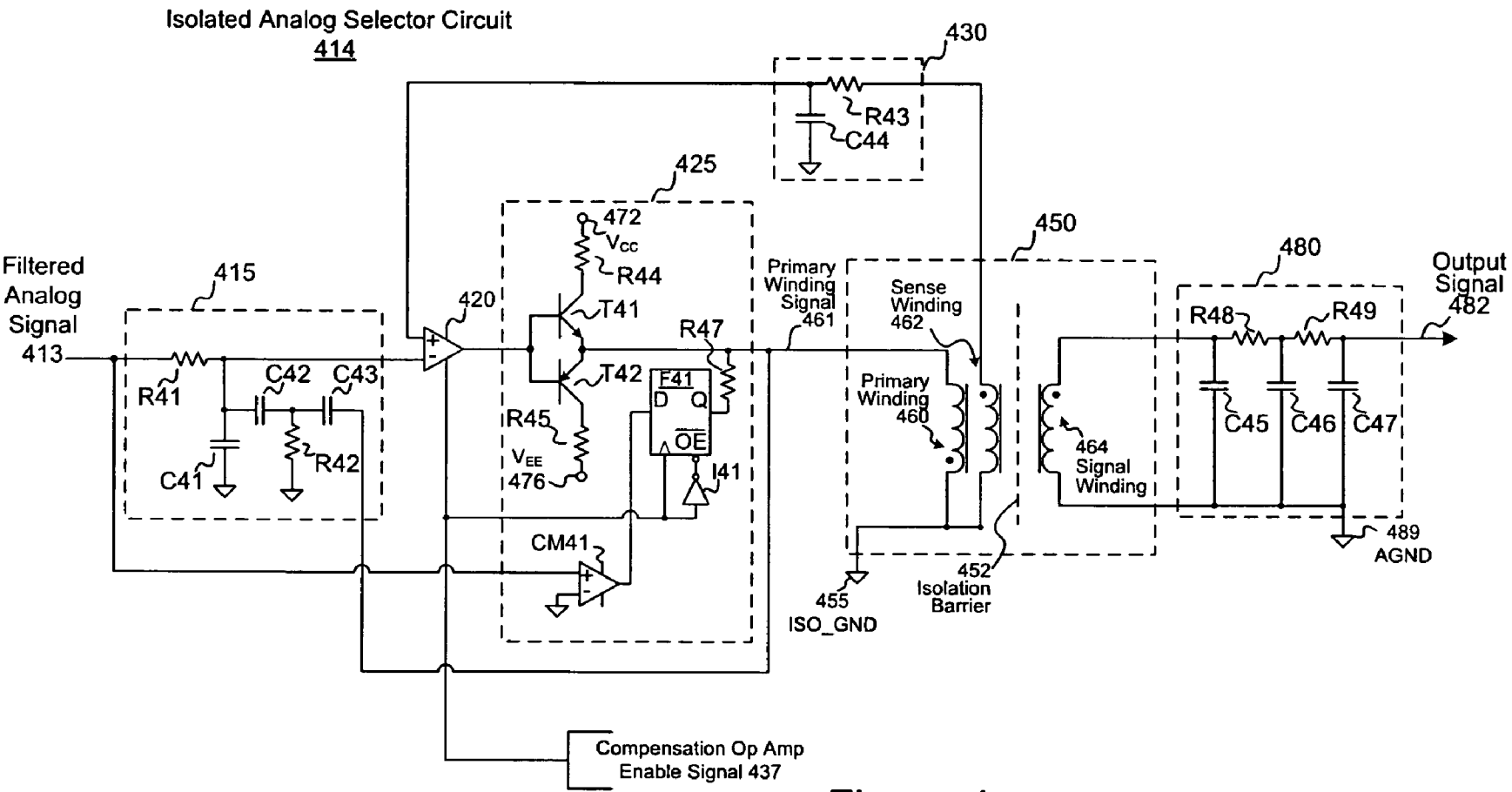
FIG. 4 is a circuit diagram of one embodiment of an isolated analog circuit.

Turning now to FIG. 4, a circuit diagram of one embodiment of an isolated analog selector circuit 414 is depicted. Embodiment 414 may comprise compensation op amp 420, which may be a high gain-bandwidth operational amplifier, such as, for example, an OPA357 manufactured by Texas Instruments®.

The sense winding 462 of the isolated analog transformer 450 may feed through lag compensation network 430 to the positive input of compensation op amp 420. This may create a negative feedback loop with compensation op amp 420 since the sense winding 462 has the opposite polarity of primary winding 460. Sense winding 462 and primary winding 460 may terminate at isolated ground (ISO_GND) 455. Signal winding 464 may terminate to analog ground (AGND) 489.

The output of compensation op amp 420 may flow to the input of drive amplifier circuit 425. Drive amplifier circuit 425 may comprise NPN T41 and PNP T42 transistors which may comprise a class B push-pull drive stage. Resistor R44 and R45 may limit the current of the drive stage under input signal over-voltage and/or over-current conditions. Since the class B stage of NPN transistor T41 and PNP transistor T42 may have some limitations when the input signal is near zero volts, resistor R47 may be pulled high (to $V_{CC}$) or low (to $V_{EE}$) by comparator CM41. This may provide bias to either NPN T41 or PNP T42 when the input to the drive amplifier circuit 425 is near zero volts and may maintain a low output impedance of drive amplifier circuit 425 for all voltage levels to drive primary winding 460. As discussed above, maintaining low output impedance between the drive amplifier 425 and primary winding 460 may maintain a high enough loop gain of compensating op amp 420 circuitry and, as such, may yield more a more accurate measurement.

Comparator CM41 and flip-flop F41 may determine whether R47 is pulled high or low at the point in time when the comparator op amp enable signal 437 is asserted—the op amp enable signal 437 may be connected to the "clock" and/or "latch" input of flip-flop F41. As such, the D input may determine the output on Q at the time the output enable signal 437 rises (e.g., creates a clock and/or latch signal). Resistor R47 may only be pulled high or low by comparator CM41 when the op amp enable signal is high, since the op amp enable signal 437 may be connected to the inverted output enable signal (shown in FIG. 4 passing through inverter I41) of flip-flop F41. As such, when output enable signal 437 is not asserted, the output of F41 may be tri-stated, which may cause R47 to be unconnected to or loading the primary winding 460.

The output of drive amplifier circuit 425 may form primary winding signal 461. Primary winding signal 461 may drive primary winding 460. Primary winding signal 461 may also be fed back into the negative pin of compensation op amp 420 through lead compensation network 415. As discussed above, in an alternative embodiment (e.g., where compensation op amp 420 comprises drive amplifier circuitry and/or has low output impedance), the output of compensation op amp 420 may directly form primary winding signal 461.

As shown in FIG. 4, lead compensation network may comprise capacitors C41, C42, and C43 and resistors R41, R42. In this configuration any ramp voltage on the output of the drive amplifier circuit 425 due to the compensating action of compensation op amp 420 (i.e., current produced when the magnetizing current of the isolated analog selector transformer inductance is ramping up) may cause a direct current to flow through capacitor C43 and resistor R42, which may produce a direct current voltage drop across resistor R42. The direct current voltage drop on resistor R42 may block direct current through C42 and resistor R41. As such, compensation op amp 420 may be stabilized properly with lead compensation network 415 without introducing error due to direct current flowing through resistor R41.

As primary winding 460 is driven by the output of compensation op amp 420 and drive amplifier circuit 425, a substantially equivalent output signal may be produced on sense winding 462. This signal may pass through lag compensation network 430 which may comprise a series resistor R43 and capacitor C44. The compensated signal may then flow to the positive input of compensation op amp 420, creating a negative feedback loop since the polarity of the sense winding 462 may be reversed from that of primary winding 460.

As primary winding 460 is driven by the output of compensation op amp 420 and drive amplifier circuit 425, a substantially linear equivalent of the filtered analog input signal 413 may be produced on signal winding 464 through isolation barrier 452. The output on signal winding 464 may pass through snubber/output filter network 480. Snubber/output filter network 480 may be comprised of capacitors C45, C46, and C47 and resistors R48, R49. Capacitor C45 may create a high frequency filter in combination with the winding resistance of signal winding 464. Resistor R48 and capacitor C46 may form a stabilizing snubber to de-Q the compensation op amp circuitry parasitics. Resistor R49 and capacitor C47 may provide an additional low pass filter pole to increase immunity to common mode transients.

The compensation op amp 420 and class B amplifier T41, T42, resistances R41-R49, and capacitances C41-C47 may be chosen such that the output voltage 482 may be settled within one count of an A/D converter. Alternatively, or in addition, the settle time of isolated analog selector circuit 414 may correspond to (e.g., be less than or equal to time differential 353 of FIG. 3*a*). In one embodiment, the resistance values shown in Table 1 and capacitance values of Table 2 may be used to obtain the desired settling time:

TABLE 1

| FIG. 4 Resistance Values | |
|---|---|
| R41 | 5 KΩ |
| R42 | 10 KΩ |
| R43 | 499 Ω |
| R44 | 1 Ω |
| R45 | 1 Ω |
| R47 | 499 Ω |
| R48 | 340 Ω |
| R49 | 1 KΩ |

TABLE 2

| FIG. 4 Capacitance Values | |
|---|---|
| C41 | 47 pF |
| C42 | 47 pF |
| C43 | 47 pF |
| C44 | 220 pF |
| C45 | 22 pF |
| C46 | 1000 pF |
| C47 | 100 pF |

In the FIG. 4 embodiment, compensation op amp 420 may comprise an OPA357 operational amplifier, flip-flop F41 may comprise a 74LV374 positive edge trigger three-state flip-flop, and comparator CM41 may comprise a TL331 single differential comparator.

It should be understood that the analog selector circuit and associated control signals, analog multiplexer, and A/D converter disclosed herein could be used with any number of isolating transformers known in the art comprised of virtually any winding and/or magnetic core material known in the art including, but not limited to, ferrite, iron, or the like. As such, the above described system should not be read as limited to any particular isolating transformer implementation.

B. Printed Circuit Board Isolated Transformer

Figure 5:
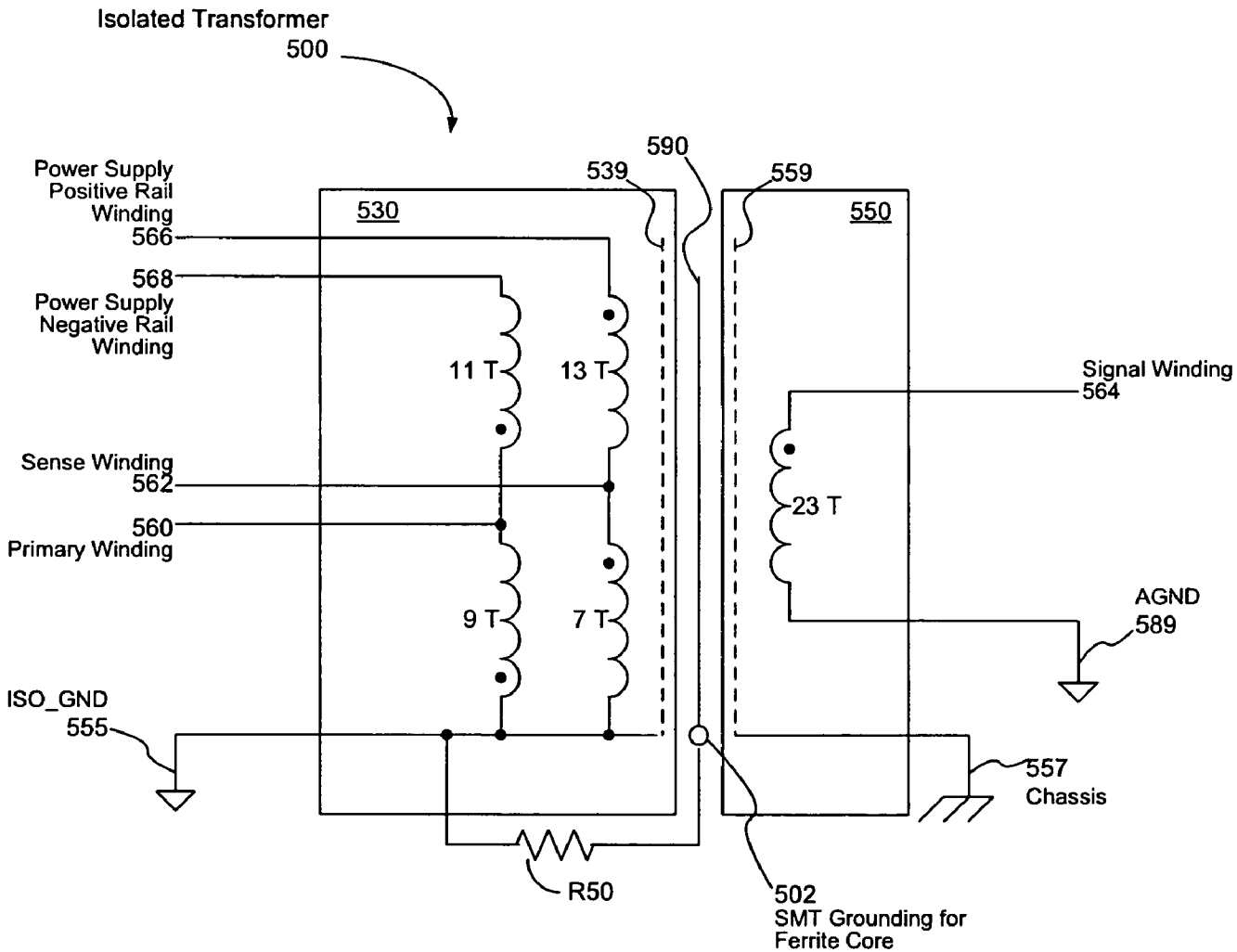
FIG. 5 is a construction schematic of one embodiment of a PCB isolated transformer.

Turning now to FIG. 5, a construction schematic of one embodiment of a isolated transformer 500 is depicted. Isolated transformer 500 may comprise a primary winding 560 comprising nine (9) turns, sense winding 562 comprising seven (7) turns, power supply positive rail winding 566 comprising thirteen (13) turns, and power supply negative rail winding 568 comprising eleven (11) turns. The windings 560, 562, 566, and/or 568 may be formed as traces on primary substrate 530. In the FIG. 5 embodiment, primary substrate 530 may comprise a PCB. As such, Windings 560, 562, 566, 568 may be disposed on one or more inner layers of primary PCB 530. In this embodiment, primary PCB 530 may be comprised on a plurality of layers (e.g., four). Primary PCB 530 may comprise a Faraday shield 539 disposed on its outer layers (e.g., top and bottom two (2) layers). The number of windings depicted in FIG. 5 are provided for illustrative purposes and may vary in different embodiments, all of which are included within the scope of this disclosure. Although primary PCB 530 is depicted as comprising positive and negative power supply rail windings 566 and 568, one skilled in the art would recognize that the PCB isolated transformer of this disclosure could include only a single power supply rail winding or no power supply rail windings. As such, this disclosure should not be read as limited to any particular number of positive and/or negative power supply rail windings 566, 568.

A signal winding 564 comprising twenty three (23) turns may be disposed on secondary substrate 550. In the FIG. 5 embodiment, secondary substrate 550 may comprise a PCB. As such, signal winding 564 may be disposed on one or more inner layers of secondary PCB 550. In this embodiment, secondary PCB 550 may comprise a plurality of layers (e.g., four). Signal winding 564 may be formed as one or more traces on secondary PCB 550. Secondary PCB may comprise a secondary Faraday field 559, which may be disposed on the outer layers (e.g., top and bottom two (2) layers) of the secondary PCB 550.

A surface mount (SMT) grounding clip 502 may connect the transformer core 590 and/or core clip (not shown) to ISO_GND 555 through a resistor R50. Signal winding 564 may be electrically coupled to analog ground (AGND) 589. Secondary Faraday shield 559 may be electrically coupled to a chassis 557 and primary Faraday shield 539, primary winding 560, sense winding 562, and positive and negative rail windings 566, 568 may be electrically coupled to an isolated ground (ISO_GND) 555. Primary PCB 530 may be isolated from secondary PCB 570 by an isolation barrier (not shown).

Figure 6B:
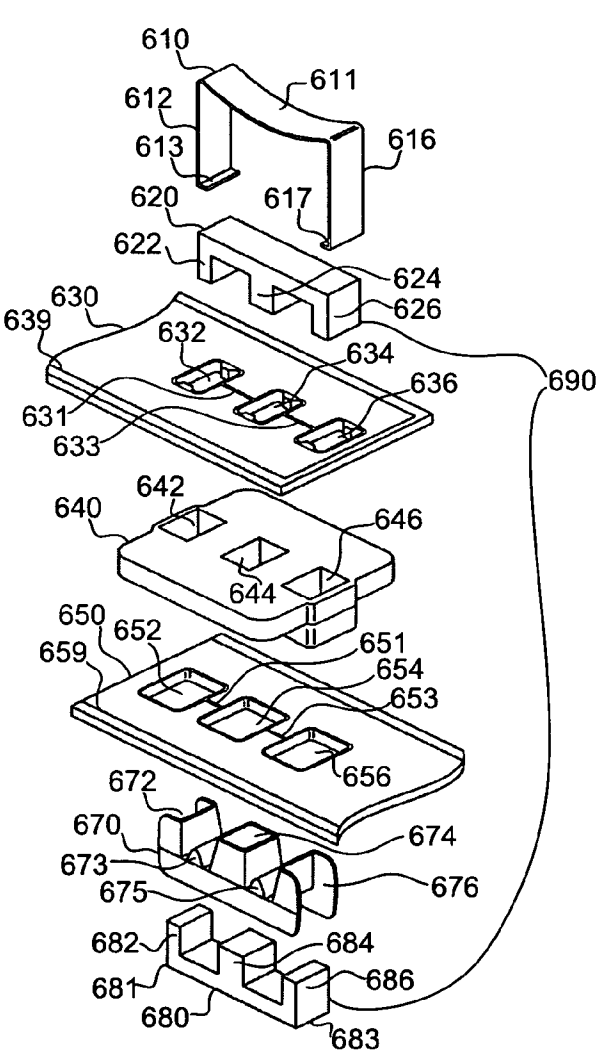
FIGS. 6*a*, 6*b* depicts an embodiment of a PCB transformer assembly.
Figure 6A:
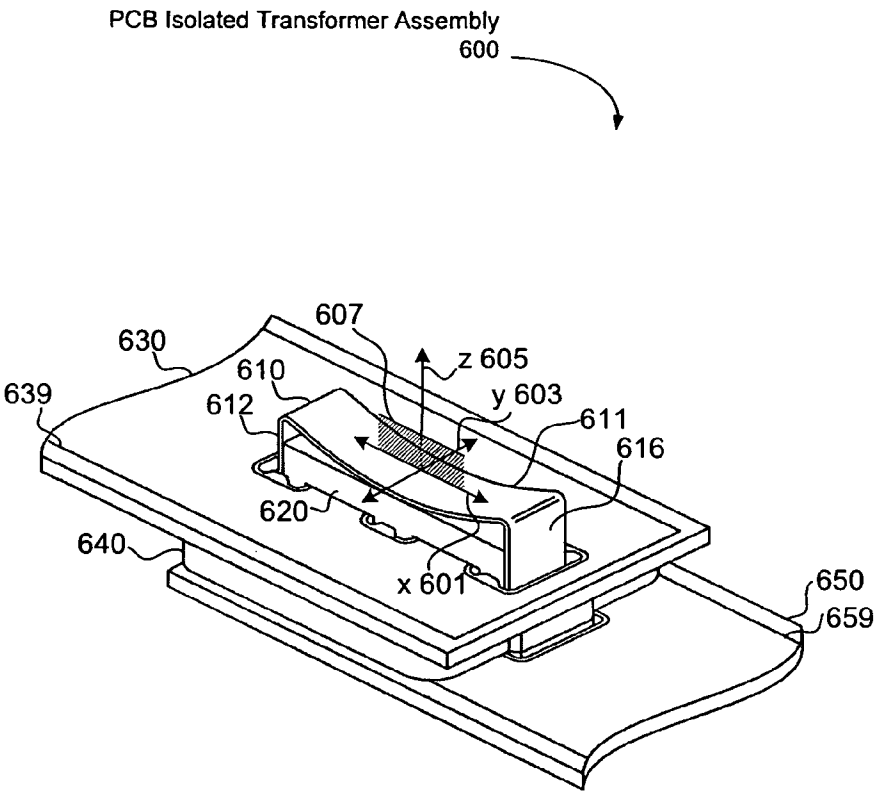

Turning now to FIGS. 6*a* and 6*b*, one embodiment of a PCB isolated transformer assembly 600 is depicted. FIG. 6*a* depicts PCB isolated transformer assembly 600 when assembled, and FIG. 6*b* shows the PCB isolated transformer assembly 600 in an exploded view to depict the components of the PCB isolated transformer assembly 600.

Referring now to FIG. 6*b*, PCB isolated transformer assembly 600 may be comprised of a primary substrate 630 and a secondary substrate 650. Primary substrate 630 and secondary substrate may comprise a primary PCB 630 and secondary PCB 650. In one embodiment, primary PCB 630 and secondary PCB 650 may be formed from a single PCB (not shown) that is scored and separated into two pieces comprising the primary and secondary PCB 630, 650.

A core 690 may be disposed between the primary and secondary PCBs to allow electromagnetic communication therebetween. In the FIGS. 6*a* and 6*b* embodiment, core 690 may be an E-E core comprised of a first E core half 620 and second E core half 680 which, when joined, may form E-E core 690. Although PCB isolated transformer assembly 600 is depicted in FIGS. 6*a* and 6*b* as having an E-E core 690, one skilled in the art would understand that any core configuration could be used under the teachings of this disclosure. As such, this disclosure should not be read as limited to any particular transformer core type and/or configuration.

Primary PCB 630 may comprise three voids 632, 634, 636. Voids 632, 634, and 636 may be configured to receive first E core half 620, a portion of first insulator 640, and a portion of second insulator 670. Secondary PCB 650 may comprise three voids 652, 654, 656. Voids 652, 654, and 656 may be configured to receive second E core half 680, hollow flanges 642, 644, and 646 of first insulator 640, and flanges 672, 674, and 676 of second insulator 670. The position of first E core half 620, second E core half 680, first insulator 640, and second insulator 670 relative to voids 632, 634, 636 and 652, 654, 656 is described in more detail below in conjunction with FIGS. 7*a* and 7*b*.

First E core half 620 and second E core half 680 may be comprised of any magnetic and/or electromagnetic core material known in the art including, but not limited to: a ferrite core (e.g., Tomita core material 2G1; an iron core; or the like). One skilled in the art would recognize that any magnetic core material could be used under the teachings of this disclosure. As such, this disclosure should not be read as limited to any particular core type, configuration, and/or material.

The voids 632, 634, and 636 of primary PCB 630 may be aligned with the voids 652, 654, and 656 of secondary PCB 650. As such, first insulator 640 may be disposed (i.e., sandwiched) between primary PCB 630 and secondary PCB 650. When so assembled, the voids 632, 634, 636 and 652, 654, 656 of primary PCB 630 and secondary PCB 650 may be aligned such that the E-E core 690 halves 620 and 680 may be joined therein. In this embodiment, the first E core half legs 622, 624, and 626 may connect to second core half legs 682, 684, and 686 to form the E-E core 690.

The hollow flanges 642, 644, and 646 of first insulator 640 may be received by the voids 652, 654, and 656 of secondary PCB 650, and the opening of each flange 642, 644, and 646 may align with a corresponding void 632, 634, and 636 on primary PCB 630. This alignment may allow the legs 622, 624, and 626 of first E core 620 to fit within voids 632, 634, and 636 of primary PCB 630 and hollow flanges 642, 644, and 646 of first insulator 640.

The alignment may further allow flanges 672, 674, and 676 of second insulator 670 to fit within voids 652, 654, and 656 of secondary PCB 650, first insulator 640, and first E core half 620. Flange 674 may be hollow and configured to receive a portion of center leg 624 of first E core half 620. Second insulator 670 may further comprise protrusions 673 and 675. Protrusions 673 and 675 may press fit secondary PCB 650 to first insulator 640 when PCB isolated transformer assembly 600 is assembled. The operation of protrusions 673 and 675 is discussed in more detail below in conjunction with FIG. 7*a*.

Second E core half 680 may comprise three legs 682, 684, and 686. Leg 682 may be configured to be received by flange 672 of second insulator 670. Flange 672 may be generally "U" shaped. Leg 684 may be configured to be received by hollow flange 674, and leg 686 may be configured to be received by U-shaped flange 676.

Clip 610 may comprise two prongs 612 and 616 configured to be inserted through voids 632 and 636 of primary PCB 630 and through voids 652 and 656 of secondary PCB 650. Prongs 612 and 616 may be joined by member 611. Member 611 may be comprised of a resilient material which may deform to allow prongs 612 and 616 to be inserted through the PCB isolated transformer assembly 600. Hollow flanges 642, 646 of first insulator 640 may be adapted to receive first and second prongs 612 and 616. Prongs 612 and 616 may comprise retention clips 613 and 617 which are configured to engage a portion 681 and 683 of second E core half 680 (e.g., corners 681 and 683 of second E core half 680). After insertion, resilient member 611 may exert a force to spring back to its original shape. This force may press-fit first E core half 620 to second E core half 680 and, in this manner, clip 610 may secure the PCB isolated transformer assembly 600 together. In this embodiment, clip 610 may hold together first E core half 620, primary PCB 630, first insulator 640, secondary PCB 650, second insulator 670, and second E core half 680 when clip prongs 612, 616 are inserted through voids 632, 636 and 652, 656 and retention clips 613, 617 engage portions 681, 683 of second E core half 680.

Referring now to FIG. 6*a*, an embodiment of a PCB isolated transformer assembly 600 when so assembled is depicted. Member 611 of clip 610 may engage top E core half 620 to press-fit top E core half 620 to second E core half 680 (not shown in FIG. 6*a*). First insulator 640 may be disposed between primary PCB 630 and secondary PCB 650 to isolate primary PCB 630 from secondary PCB 650. It would be understood by one skilled in the art that other methods and/or techniques of joining first E core half 620 to the second E core half 680 to assemble PCB isolated transformer assembly 600 could be used without departing from the teachings of the disclosure. For example, the E-E core 690 could be formed from first E core half 620 and second E core half 680 using conductive glue, welding, an external clamp, a notch fit, or the like. As such, the PCB isolated transformer assembly 600 of this disclosure should not be read as limited to any particular joining technique and/or methodology.

In the FIGS. 6*a* and 6*b* embodiment, primary PCB 630 and secondary PCB 650 may be independently attached and/or mounted using, for example, standoffs on a support shelf. The PCB isolated transformer assembly 600 itself, comprising the clip 610, first E core half 620, first insulator 640, second insulator 670 and second E core half 680 may be self-constrained by the fitting E-E core 690 comprised of E core halves 620 and 680, first insulator 640, second insulator 670, and clip 610.

In the FIGS. 6*a* and 6*b* embodiment, primary and secondary PCBs 630, 650 may comprise a four (4) layer PCB. The outer layers of both primary and secondary PCBs 630, 650 may comprise a Faraday shield 639, 659 for any windings (not shown) within one or more inner layers of PCBs 630, 650. Although not depicted, additional Faraday shielding could be placed about circuitry in proximity to PCB isolated transformer assembly 600 (e.g., the isolated analog selector circuitry discussed above and/or capture circuitry, such as a multiplexer, A/D converter, and/or sample-and-hold). Such additional Faraday shielding may improve the overall system's performance resistance to error introduced by common mode transients. One skilled in the art would recognize that shielding substantially all of the circuitry connected to primary PCB 630 from circuitry connected to secondary PCB 650 may be beneficial to such common mode rejection performance. The teachings of this disclosure may encompass any of these alternative shielding approaches. As such, this disclosure should not be read as limited to any particular shielding configuration.

Referring again to FIG. 6*b*, primary PCB 630 may comprise shield slits 631 and 633, and secondary PCB 650 may comprise shield slits 651, 653. The slits 631, 633, 651, and 653 may be made through the first (i.e., top) and second (i.e., bottom) Faraday shields 639, 659 of the primary and secondary PCB 630, 650, respectively. For instance, although not visible in FIG. 6*b*, slits in primary PCB 630 corresponding to slits 631, 633 may be formed in the bottom (not visible) Faraday shield 639 of primary PCB 630, and slits in secondary PCB 650 corresponding to slits 651, 653 may be formed in the bottom (not visible) Faraday shield 659 of secondary PCB 650. Slits 631, 633, 651, and 653 may prevent shorting between any of the legs 622, 682, 624, 684, and/or 626, 686 of the E-E core 690.

Referring again to FIG. 6*b*, the Faraday shields 639, 659, the shield slits 631, 633, 651, 653, the core 690 and clip 610 may be symmetrically placed about a plane 607. Plane 607 may bisect substantially the center of PCB isolated transformer assembly 600. For example, in FIG. 6*b*, axes 601, 603, and 605 may represent coordinate x, y, and z axes (e.g., 601 may represent an "x" axis, 603 may represent a "y" axis, and 605 may represent a "z" axis). As such, plane 607 may be defined along the "x" axis 601 and "z" axis 605 where the "y" axis (603) is zero (0). The zero point for the "y" axis (603) may be at substantially the center of the PCB transformer assembly 600.

Faraday shields 639 and 659, Faraday shield slits 631, 633, 651, and 653, E-E core 690, and clip 610 may be substantially symmetrical about the center of PCB transformer assembly 600 and plane 607 defined thereon. Accordingly, plane 607 may form a symmetrical axis of the E-E core 690 and clip 610. This symmetry and location of the slits may cause current flow created due to capacitive coupling between conductors on the primary to secondary PCBs (when a common mode voltage is applied to the input voltage signal), to be symmetrical about the core 690 and have little net coupling to the center leg 624, 684 that couples the primary, sense and signal windings of the PCB isolated transformer assembly 600. For example, a common mode voltage differential may exist between primary PCB 630 and secondary PCB 650 creating a capacitor therebetween. As the voltage differential varies (e.g., due to an AC signal driving the primary shield 639 and secondary shield 659 (not shown), current may flow across the primary-secondary PCB 630, 650 capacitor. The symmetry of the Faraday shields 639, 659 may position slits 631, 633, 651, and 653 symmetrically about plane 607 (e.g., in order for faraday shield 639 to be symmetrical about plane 607, slits 631 and 633 may be placed along plane 607 and, in order for faraday shield 659 to be symmetrical about plane 607, slits 651 and 653 may be placed along plane 607). This symmetry, along with the symmetry of the core 690 and clip 610 may produce symmetrical current distribution (due to current feeding primary-secondary capacitance) in the Faraday shields 639, 659 and first insulator 640, which may reduce and/or minimize the net coupling to the core center leg 624, 684. This may increase the accuracy of the PCB isolated transformer assembly 600 by decreasing capacitive coupling errors.

The Faraday shields 639 and 659 disposed on the outer layers of the primary and secondary PCBs 630 and 650 may make a complete turn around the outside of the E-E core 690. This may reduce magnetic coupling from any adjacent transformers circuitry (e.g., another PCB isolated transformer (not shown)).

Insulators 640 and 670 may form an isolation barrier between primary PCB 630 and secondary PCB 650. A primary transformer winding (not shown) may be disposed within one or more inner two layers of primary PCB 630, and a signal transformer winding (not shown) may be disposed within one or more inner two layers of secondary PCB 650. In this embodiment, the Isolation barrier 640, 670 may isolate the primary winding (not shown) from the signal winding (not shown).

Figure 7A:
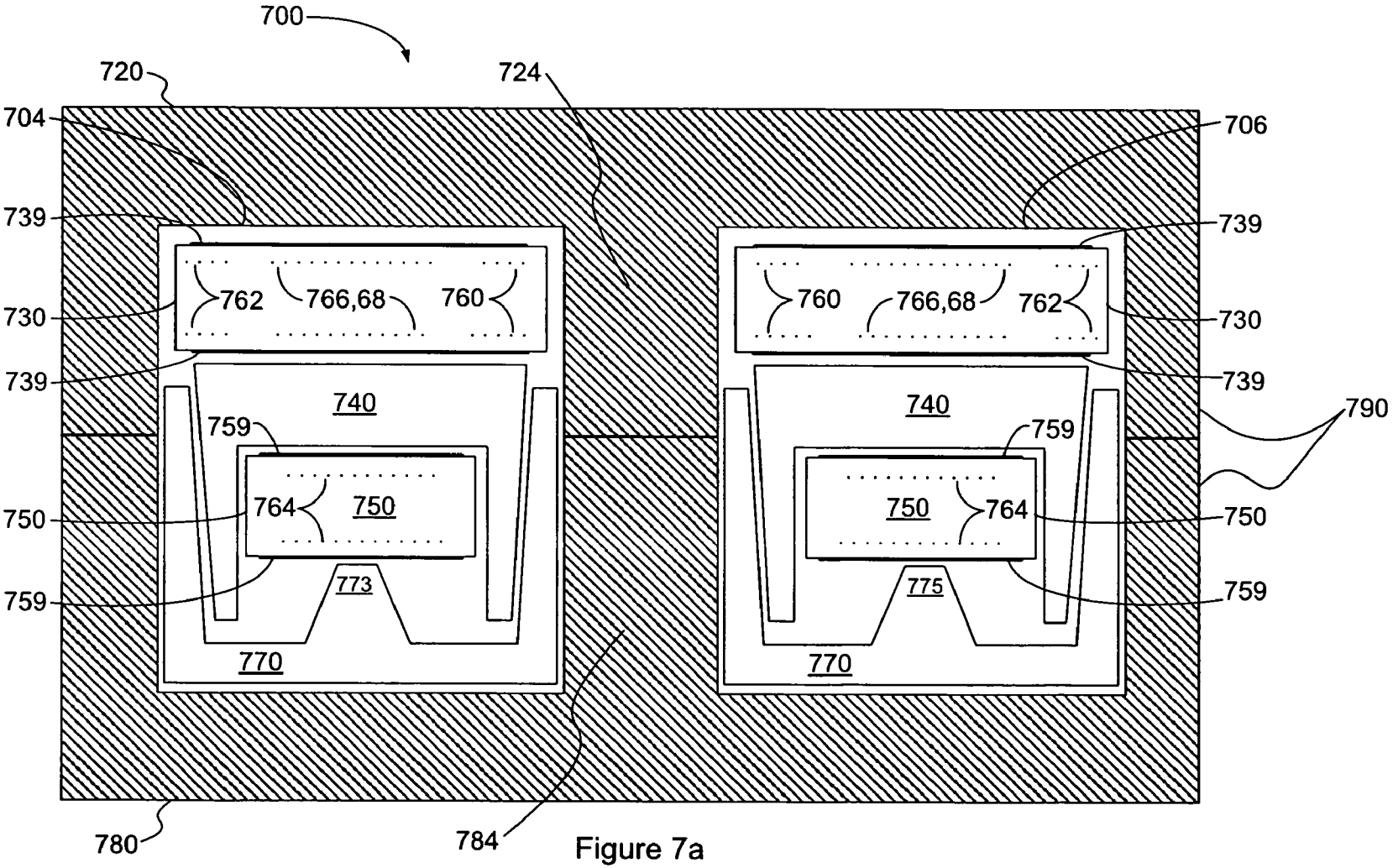
FIG. 7*a* depict a cut-away view of one embodiment of a PCB transformer assembly.

Turning now to FIG. 7*a*, a cross-sectional view of one embodiment of a PCB isolated transformer 700 is depicted. The cross-sectional view depicted in FIGS. 7*a* and 7*b* may correspond to a cut-away of the PCB isolated transformer assembly 600 of FIG. 6*a* along plane 607.

When assembled, first E core half 720 may be pressed against second E core half 780 to form E-E core 790. The legs of first E core half 720 and second E core half 780 may join through voids in the primary PCB 730 and secondary PCB 750 (elements 632, 634, 636 and 652, 654, 656 in FIGS. 6*a* and 6*b*) to allow electromagnetic communication therebetween. As such, when assembled, first E core half 720 and second E core half 780 may form an E-E core 790.

When the first and second E core halves 720, 780 are joined, two windows 704, 706 within the E-E core 790 may be formed. The windings for the primary winding 760 may be disposed on the inner edge (relative to windows 704, 706) of primary PCB 730. In the FIG. 7*a* embodiment, primary winding 760 may exit the page, traverse the center leg 724, 784 of the E-E core 790, and reenter the page at window 706. As such, primary winding 760 may form a loop around (i.e., circle) center leg 724, 784 of E-E core 790.

Sense winding 762 may comprise seven (7) windings disposed on the outer edge of window 704 and 706 and may similarly loop center leg 724, 784 of the E-E core 790. Positive and negative power source rail windings 766, 768 may comprise twenty-four (24) windings (thirteen (13) positive and eleven (11) negative) and may loop center leg 724, 784 of E-E core 790. Signal winding 764 may be comprised of 23 windings, and may be evenly distributed relative to windows 704, 706.

As discussed above, although FIGS. 7*a* and 7*b* depict a certain number of windings for primary winding 760, sense winding 762, signal winding 764, positive power source rail winding 766, and negative power source rail winding 768, the teachings of this disclosure may be applied to any number of windings 760, 762, 764, 766, 768. Accordingly, this disclosure should not be read as limited to any particular number of windings 760, 762, 764, 766, 768. In addition, the PCB isolated transformer 700 of this disclosure may comprise a single and/or no power rail windings 766, 768. As such, this disclosure should not be read as limited to particular number of positive and/or negative power supply rail windings 766, 768.

Windings 760, 762, 766, 768 may be disposed on one or more inner layers of primary PCB 730, and winding 764 may be disposed on one or more inner layers of secondary PCB 750. The windings 760, 762, 764, 766, and 768 may be formed as PCB traces on the primary and/or secondary PCBs, respectively.

Faraday shield 739 may be disposed on the outer layers of primary PCB 730, and Faraday shield 759 may be disposed on the outer layers of secondary PCB 750. Although not shown, the Faraday shields 739, 759 of primary and secondary PCB 730, 750 may comprise shield slits (not shown) to prevent shorting between the legs of E-E core 790 (such Faraday shield slits are depicted in FIG. 6*b* as elements 632, 634 and 652, 654).

As discussed above, primary winding 760, sense winding 762, positive power source rail winding 766, negative power source rail winding 768 and signal winding 764 may comprise multiple PCB trace windings on one or more inner layers of the primary and secondary PCBs 730, 750. As such, windings 760, 762, 764, 766, 768 may comprise vias that connect various portions of the windings together between one or more layers of the PCB 730, 750. In one embodiment, where the windings are disposed on an inner layer of PCB 730 and/or 750, the vias may be buried vias as known in the PCB fabrication arts. Buried vias may not be exposed on the outer Faraday shield layers 639, 659 of PCBs 730, 750.

In an alternative embodiment, a regular via could be used to connect windings 760, 762, 764, 766, 768 disposed on multiple layers of primary and/or secondary PCBs 730, 750. As known in the PCB fabrication arts, a regular via may be formed through both the external (e.g., Faraday shield layers 739, 759) and internal layers of primary and/or secondary PCBs 730, 750 to connect the windings 760, 762, 764, 766, 768 disposed therein. In this embodiment, additional shielding material (not shown) may be disposed in parallel to Faraday shields 739 and/or 759 on and in electrical communication with Faraday shields 739 and/or 759 on primary and/or secondary PCB 730, 750, respectively. One skilled in the art, however, would recognize that any intra-layer winding 760, 762, 765, 766, 768 connecting method and/or technique (e.g., buried vias, standard vias, etc.) could be used under the teachings of this disclosure. As such, this disclosure should not be read as limited to any particular intra-layer winding 760, 762, 764, 766, 768 connection method and/or technique.

In addition, one skilled in the art would recognize that an isolated transformer according to the teachings of this disclosure could be fabricated using means other than a printed circuit board (PCB), including, but not limited to: integrated circuit fabrication (e.g., as an application-specific integrated circuit (ASIC)); systems and methods used to fabricate very-large-scale integration (VLSI) circuitry; or the like.

In addition, although this disclosure discusses forming the isolated transformer 700 from a primary and secondary PCB, the transformer disclosed herein could be formed on any substrate material known in the art. As used herein, a substrate may refer to any supporting material on which a circuit and/or trace may be formed and/or fabricated. As such, this disclosure should not be read as limited to any particular fabrication method and/or technique.

First insulator 740 may isolate primary PCB 730 comprising primary winding 760 from secondary PCB 750 comprising signal winding 764. Secondary PCB 750 may be held in place by second insulator 770 and first insulator 740. Second insulator 770 may isolate secondary PCB 750 comprising signal winding 764 from core 790 and/or core clip (not shown). Core 790 and core clip (not shown) may be electrically connected to primary PCB 730 via Faraday shield 739 by SMT grounding clip (not shown). First and second insulators 740, 770 may be formed from any insulating and/or isolation material known in the art including, but not limited to: plastic, ceramic, rubber, composite, or the like.

In the embodiment depicted in FIGS. 6*a* and 6*b*, and 7*a* and 7*b*, core 790 and core clip (not shown, 610 in FIGS. 6*a*, 6*b*) are connected to Faraday shield 739 of primary PCB 739. As such, secondary PCB 750 is isolated from core 790 and clip (not shown) by second insulator. In an alternative embodiment, core 790 could be connected to secondary PCB 750 via Faraday shield 759. In this embodiment, primary PCB 730 may require a secondary insulator (not shown) to isolate primary PCB 730 from core 790 and/or clip (not shown). In another alternative embodiment, core 790 and clip (not shown) may be isolated from both primary and secondary PCBs 730, 750. In this embodiment, both primary and secondary PCBs 730, 750 may require isolation from core 790 and the core clip (not shown). One skilled in the art would recognize that the transformer of this disclosure may be implemented under any isolation methodology and/or technique known in the art. As such, this disclosure should not be read as limited to any particular isolation methodology and/or technique.

In yet another embodiment, primary and secondary PCB 730, 750 may comprise a single PCB having a high layer count (e.g., eight (8) or more layers). In this embodiment, primary windings 760, sense winding 762, and positive and/or negative rail windings 766, 768 may be disposed on a first set of layers (e.g., upper layers) and a signal winding 764 may de disposed on a secondary set of layers (e.g., lower layers). In this embodiment, PCB layers separating the upper and lower layers may comprise isolation between primary winding 760 and signal winding 740. One skilled in the art would recognize that any winding isolation, shielding, and/or fabrication technique known in the art could be used under the teachings of this disclosure. As such, this disclosure should not be read as limited to any particular winding isolation, shielding and/or fabrication technique.

Second insulator 770 may comprise protrusions 773 and 775. When PCB isolated transformer 700 is assembled, protrusions 773 and 775 may fix secondary PCB 750 in place by pressing secondary PCB between protrusions 773 and 775 and first insulator 740. As discussed above in conjunction with FIGS. 6*a* and 6*b*, a clip (i.e., element 610 of FIGS. 6*a* and 6*b*) may be used to hold isolated PCB transformer 700 assembly together. In this embodiment, a clip (not shown) may cause protrusions 773 and 775 of second insulator 770 to press secondary PCB 750 to first insulator 740. Similarly, primary PCB 730 may be secured by first E core half 720 and first insulator 740 when isolated PCB transformer 700 is assembled.

Figure 7B:
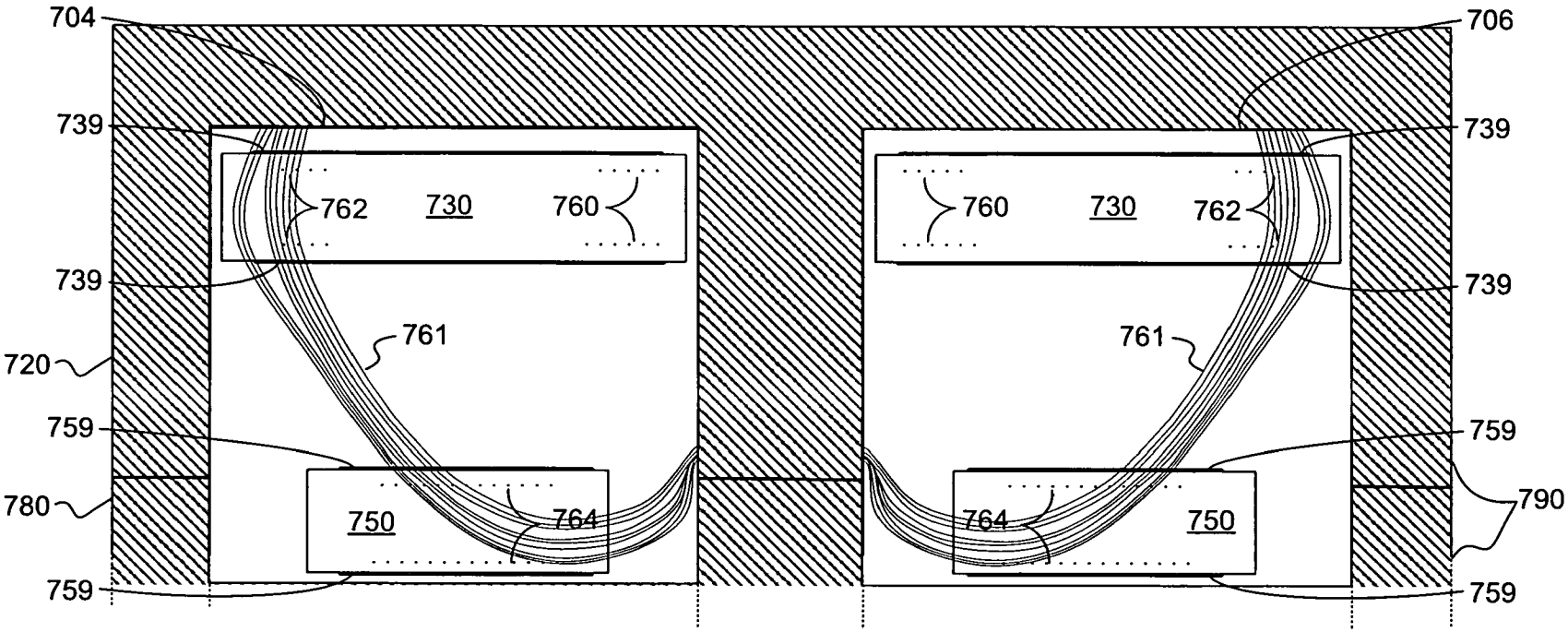
FIG. 7*b* depicts magnetic flux within a first window and a second window of an E-E core.

Turning now to FIG. 7*b*, exemplary magnetic flux contours 761 corresponding to magnetic flux generated within windows 704 and 706 of E-E core 790 by primary winding 760 is depicted. The magnetic flux depicted by magnetic flux contours 761 may be generated as primary winding 760 is driven by an analog signal, compensation circuitry, and/or a drive amplifier substantially as described above. Although FIG. 7*b* only depicts a portion of magnetic flux contours 761, one skilled in the art would recognize that magnetic flux as depicted by contours 761 would extend throughout windows 704 and 706 and the rest of E-E core 790 (e.g., encircling E-E core 790 in three (3) dimensions).

Windings 760, 762, and 764 may be located such that when the primary winding 760 is being driven, the magnetic flux, represented by magnetic flux contours 761, coupling the primary and sense windings 760 and 762 and the primary and signal windings 760 and 764 does not introduce significant error (e.g., less than 1 count of an A/D converter). Such error may be created if magnetic flux corresponding to contours 761 within window 704 or 706 couples differently to sense winding 762 and signal winding 764. For instance, if excess flux passes through sense winding 762 and not signal winding 764, an erroneously low reading on the signal winding 764 may result. Similarly, if excess flux passes through signal winding 764 and not the sense winding 762, an erroneously high heading on the signal winding 764 may result. For example, in FIG. 7*b*, portions of magnetic flux represented by flux contours 761 may couple primary winding to signal winding 764 and not sense winding 762 (i.e., some of flux contours 761 lie within signal windings 764 (allowing coupling), but outside (preventing coupling) of sense windings 762).

Such errors may be reduced and/or removed by locating the primary 760, sense 762 and signal winding 764 within one or more inner layers of primary and secondary PCBs 730, 750 so that any flux generated by primary winding 760 flows through the sense and signal windings 762, 764 in substantially equal proportion. In one embodiment, this may be done by modeling the flux contours 761 (as depicted in FIG. 7*b*) and positioning sense and signal windings 762, 764 to substantially lie along the same flux 761 contour lines. Such modeling may comprise three (3) dimensional core field modeling. This modeling may further comprise a 3D coupling model to determine the coupling between the primary winding 760 and the sense winding 762 and the coupling between the primary winding 760 and signal winding 764 and adjusting the position of the windings 760, 762, and 764 until the difference in coupling between the primary-sense winding 760, 762 and primary-signal winding 760, 764 is minimized.

FIG. 7*b* depicts an arrangement of primary and secondary PCBs 730, 750 and windings 760, 762, and 764 within E-E core 790 windows 704 and 706 such that the flux contours 761 within windows 704 and 706 produced by primary winding 760 flows through sense winding 762 and signal winding 764 in substantially equal amounts. Such precise positioning of primary, sense, and signal windings 760, 762, 764 may be possible since primary, sense, and signal windings 760, 762, 764 may be comprised of PCB traces on one or more inner layers of primary and secondary PCBs 730, 750, respectively. Such precise positioning may not be possible in traditionally formed and/or manufactured transformer windings.

As depicted in FIG. 7*b*, the flux 761 coupling the primary winding 760 to sense winding 762 may be substantially equivalent to the flux contours 761 coupling primary winding 760 to signal winding 764. Accordingly, error due to magnetic flux contours 761 within windows 704, 706 may be reduced. It would be understood by one skilled in the art that other winding configurations could be employed depending upon the type of transformer core used and/or the location of primary winding 760. As such, this disclosure should not be read as limited to any particular core and/or winding arraignment. As discussed above, the windings 760, 762, 764 may be formed using other manufacturing techniques including, but not limited to ASIC manufacturing systems and methods, and/or VLSI manufacturing systems and methods. As such, this disclosure should not be read as limited to any particular process for fabricating and/or placing winding traces to control the position of windings 760, 762, and/or 764.

Figure 8:
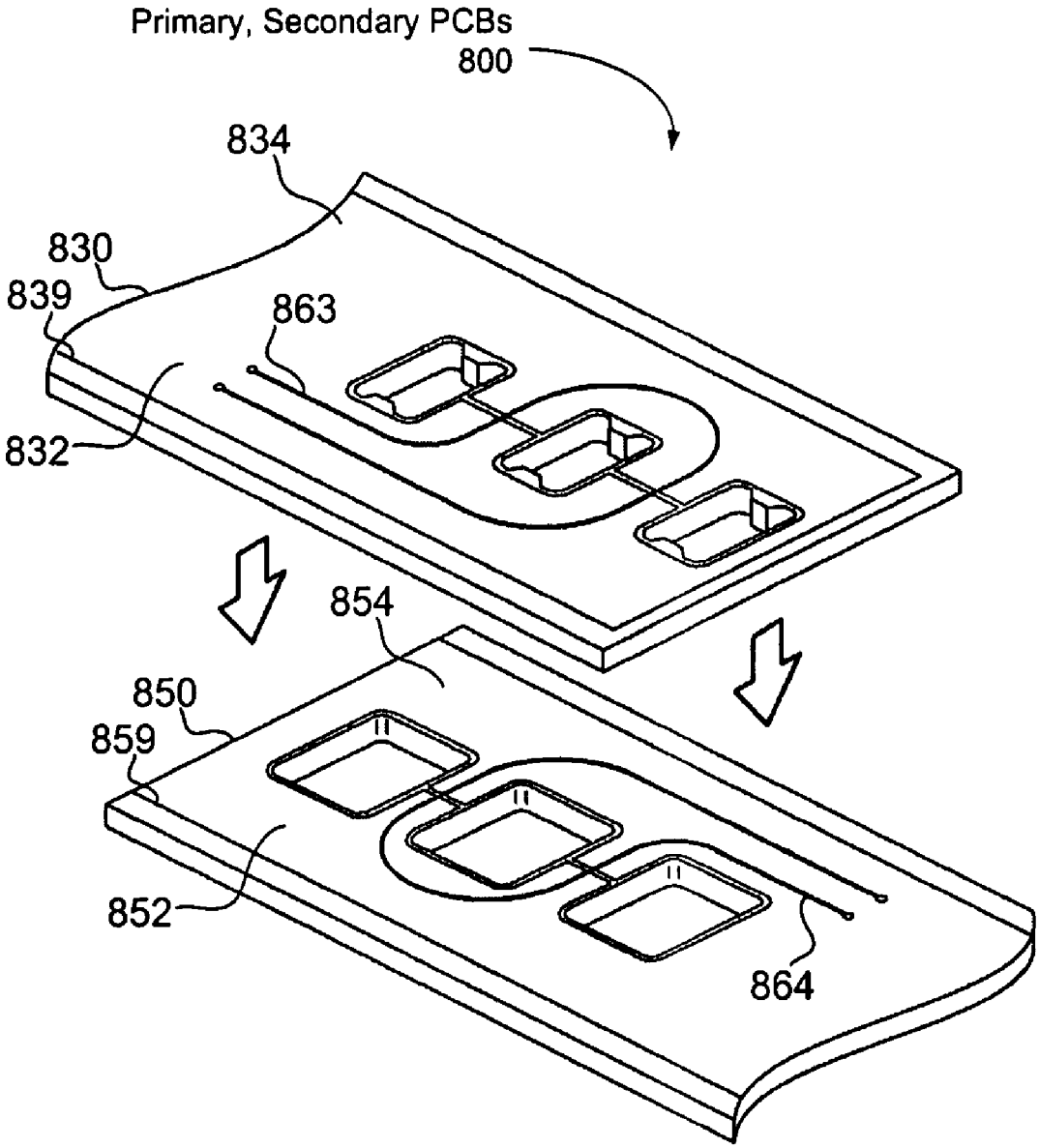
FIG. 8 depicts one embodiment of a primary winding and signal winding on a primary PCB and secondary PCB respectively.

Turning now to FIG. 8, one embodiment 800 of a primary PCB winding 863 comprised of a single trace winding on primary PCB 830 and a signal winding 864 comprised on a single trace winding on secondary PCB 850 is depicted. Although, for clarity, only one primary PCB winding 863 and signal winding 864 is depicted, it would be understood by one skilled in the art that any number of primary PCB and signal windings 863, 864 could be used according to the teachings of this disclosure including, for example, a primary PCB winding 863 comprising nine (9) turns primary winding (not shown) and signal winding 864 comprising twenty-three (23) turns. In addition, although primary and signal windings 863, 864 are depicted on an outer layer of the primary and secondary PCBs 830, 850 to be visible in FIG. 8, one skilled in the art would recognize that primary and signal windings 863, 864 could be disposed within one or more inner layers of the PCBs 830, 850 under the teachings of this disclosure.

One or more windings 863 disposed on primary PCB 830 and the signal winding 864 may be fed from opposite sides relative to the E-E core (not shown) and/or primary PCB 830 and secondary PCB 850. In addition, the windings 863 of the primary PCB 830 may be fed from a first side and/or half 832 of primary PCB 830 and signal winding 864 may be fed from a second side and/or half 854 of secondary PCB 850. First side and/or half 832 may be substantially opposite that of second side and/or half 854 (e.g., if 832 corresponds to a "bottom" of primary PCB 830, 854 may correspond to a "top" of secondary PCB 850). This relative orientation may minimize common mode coupling between signal winding 864 and the windings 863 comprising primary PCB 830. Windings 863 may include the primary winding (not shown), signal winding (not shown), and/or power source winding (not shown). As such, any current that flows in the windings 863 to and/or from signal winding 864 due to coupling therebetween (e.g., a portion of the windings not shielded by the primary and secondary Faraday shields 839, 859) when a common mode voltage is applied to the input analog signal may have a net flow through one or both windows of the E-E core (elements 704, 706 in FIG. 7*a-c*), to act as a common mode choke.

One skilled in the art would recognize that the windings 863 disposed on primary PCB 830 and signal winding 864 could be rearranged into various alternative configurations within the teachings of this disclosure (e.g., primary PCB 830 windings 863 may feed into the core from side/half 834 of primary PCB 830 and signal winding 864 may feed into the core from side/half 852 of secondary PCB 850). As such, this disclosure should not be read as limited to any particular winding feed orientation.

It will be obvious to those having skill in the art that many changes may be made to the details of the above-described embodiments without departing from the underlying principles of the invention. The scope of the present invention should, therefore, be determined only by the following claims.

I claim:

1. An isolated transformer, comprising:

a primary substrate comprising a primary winding and a sense winding, wherein the primary winding comprises one or more traces on the primary substrate, and wherein the sense winding comprises one or more traces on the primary substrate;

a secondary substrate disposed proximate to the primary substrate comprising a signal winding, wherein the signal winding comprises one or more traces on the secondary substrate;

a first insulator disposed between the primary substrate and the secondary substrate, wherein the first insulator is configured to isolate the primary substrate from the secondary substrate; and a core disposed in proximity to the primary substrate and the secondary substrate to electromagnetically couple the primary winding to the sense winding and the signal winding.

2. The isolated transformer of claim 1, further comprising a primary Faraday shield disposed on an outer layer of the primary substrate, and a secondary Faraday shield disposed on an outer layer of the secondary substrate.

3. The isolated transformer of claim 2, wherein the core is substantially symmetric, and wherein the primary Faraday shield and the secondary Faraday shield are substantially symmetric relative to the core.

4. The isolated transformer of claim 1, wherein the primary winding, the sense winding, and the signal winding are positioned such that a magnetic flux produced by the primary winding passes through the sense winding and the signal winding in substantially equal proportion.

5. The isolated transformer of claim 4, wherein the position of the sense winding and the signal winding relative to the primary winding corresponds to a magnetic flux coupling model.

6. The isolated transformer of claim 1, wherein the core is an E-E core comprising three core legs, and wherein the E-E core legs form a first core window and a second core window.

7. The isolated transformer of claim 6, wherein the primary winding and the signal winding are fed into the E-E core such that a common mode current flowing therebetween has a net flow through the first E-E core window or the second E-E core window.

8. The isolated transformer of claim 6, wherein the E-E core is comprised of a first E core half and a second E core half, the isolated transformer further comprising a retaining clip to secure the first E core half to the second E core half.

9. The isolated transformer of claim 8, wherein the E-E core is configured to be substantially symmetric about a center axis of the E-E core, and wherein the primary substrate comprises a primary Faraday shield disposed on an outer layer of the primary substrate, and wherein the secondary substrate comprises a secondary Faraday shield disposed on an outer layer of the secondary substrate, and wherein the primary Faraday shield and the secondary Faraday shield are configured to be symmetric relative to the E-E core.

10. The isolated transformer of claim 8, wherein the primary substrate comprises a first void, a second center void, and a third void configured to receive the legs of the E-E core, and wherein the secondary substrate comprises a first void, a second center void, and a third void configured to receive the legs of the E-E core.

11. The isolated transformer of claim 10, wherein the first insulator comprises a plurality of hollow flanges configured to receive the first E core half legs, and wherein the voids of the secondary substrate are configured to receive the hollow flanges of the first insulator, the isolated transformer further comprising a second insulator comprising a plurality of flanges configured to receive the second E core half legs, wherein the flanges of the first insulator are adapted to receive the flanges of the second insulator, and wherein the second insulator is configured to isolate the secondary substrate from the second E core half.

12. The isolated transformer of claim 11, wherein the retaining clip comprises a first prong and a second prong, and wherein a first hollow flange of the first insulator is configured to receive the first retaining clip prong, and a second hollow flange of the first insulator is configured to receive the second retaining clip prong, and wherein the first prong comprises a retention clip configured to engage a portion of the second E core half, and wherein the second prong comprises a retention clip configured to engage a portion of the second E core half.

13. The isolated transformer of claim 12, wherein the first clip prong is configured to be inserted through the first void of the primary substrate, a first hollow flange of the first insulator, and the first void of the secondary substrate, and wherein the second clip prong is configured to be inserted through a third void of the primary substrate, a third hollow flange of the first insulator, and the third void of the secondary substrate, and wherein the retention clips of the first prong and the second prong are configured to engage the second E core half, and wherein the connecting resilient member of the retaining clip is configured to contact the first E core half to secure the first E core half to the second E core half to thereby assemble the primary substrate, first insulator, secondary substrate, and second insulator.

14. The isolated transformer of claim 1, wherein the primary substrate comprises a primary PCB, and wherein the primary PCB is comprised of an inner layer and one or more outer layers, and wherein the primary winding is traced on the inner layer of the primary PCB and the sense winding is traced on an inner layer of the primary PCB, and wherein the secondary substrate comprises a secondary PCB, and wherein the secondary PCB is comprised of an inner layer and one or more outer layers, and wherein the signal winding is traced on the inner layer of the secondary PCB.

15. The isolated transformer of claim 14, wherein the core is symmetrical about a center axis of the core, the isolated transformer further comprising a primary Faraday shield disposed on the one or more outer layers of the primary PCB, and a secondary Faraday shield disposed on the one or more outer layers of the secondary PCB, wherein the primary Faraday shield and secondary Faraday shield are substantially symmetrical relative to the core.

16. The isolated transformer of claim 14, wherein the primary winding, sense winding and signal winding are positioned such that a magnetic flux produced by the primary winding passes through the sense winding and the signal winding in substantially equal proportion, and wherein the position of the sense winding and the signal winding relative to the primary winding corresponds to a magnetic flux coupling model.

17. An isolated printed circuit board (PCB) transformer, comprising:

a primary PCB having an inner layer, the primary PCB comprising a primary winding PCB trace and a sense winding PCB trace disposed on the inner layer of the primary PCB;

a secondary PCB having an inner layer, the secondary PCB comprising a signal winding PCB trace disposed on the inner layer of the secondary PCB;

an isolation barrier disposed between the primary PCB and secondary PCB to isolate the primary winding PCB trace and sense winding PCB trace from the signal winding PCB trace; and an E-E core disposed in proximity to the primary PCB and secondary PCB, wherein the primary winding PCB trace, the sense winding PCB trace, and the signal winding PCB trace, encircle a center leg of the E-E core, wherein the primary winding PCB trace, the signal winding PCB trace, and the sense winding PCB trace are positioned such that a magnetic flux produced by the primary PCB trace flows through the sense winding PCB trace and the signal winding PCB trace in substantially equal proportion.

18. An isolated printed circuit board (PCB) transformer, comprising:

a substantially symmetric E-E core comprising a first leg, a second center leg, and a third leg;

a primary PCB comprising an inner layer and an outer layer, the primary PCB comprising a first opening, a second center opening, and a third opening, wherein the first, second center, and third primary PCB openings are configured to receive the first, second center, and third legs of the E-E core, the primary PCB comprising:

a primary winding formed as a plurality of PCB traces on the inner layer of the primary PCB, a sense winding formed as a plurality of PCB traces on the inner layer of the primary PCB, and a primary Faraday shield disposed on the outer layer of the primary PCB;

a secondary PCB comprising an inner layer and an outer layer, the secondary PCB comprising a first opening, a second center opening, and a third opening, wherein the first, second center, and third secondary PCB openings are configured to receive the first, second center, and third legs of the E-E core, the secondary PCB comprising:

a signal winding formed as a plurality of PCB traces on the inner layer of the secondary PCB, and a secondary Faraday shield disposed on the outer layer of the secondary PCB;

a first insulator disposed between the primary PCB and secondary PCB, wherein the first insulator is configured to isolate the primary PCB from the secondary PCB, the first insulator comprising three hollow flanges configured to receive the E-E core legs, and wherein the first, second center, and third openings of the secondary PCB are configured to receive the hollow flanges; and a second insulator to isolate the secondary PCB from the core comprising three flanges configured to be received by the first, second center, and third openings of the secondary PCB and to be maintained within the three hollow flanges of the first insulator, wherein, the primary Faraday shield and the secondary Faraday shield are substantially symmetric relative to the E-E core, and wherein the sense winding and the signal winding are positioned relative to the primary winding such that a magnetic flux produced by the primary winding passes through the sense winding and the signal winding in substantially equal proportion.

* * * * *